US006637468B1

(12) United States Patent
Wu

(10) Patent No.: US 6,637,468 B1
(45) Date of Patent: Oct. 28, 2003

(54) HIGH SPEED ENGINE COOLANT FLUSH AND FILTRATION SYSTEM AND METHOD

(76) Inventor: Derek Chen-Chien Wu, 32168 Champlain St., Hayward, CA (US) 94544

( * ) Notice: Subject to any disclaimer, the term of this patent is extended or adjusted under 35 U.S.C. 154(b) by 301 days.

(21) Appl. No.: 09/617,188

(22) Filed: Jul. 14, 2000

Related U.S. Application Data

(60) Provisional application No. 60/144,611, filed on Jul. 20, 1999.

(51) Int. Cl.[7] ..... B65B 31/00; B67C 3/00

(52) U.S. Cl. ..... 141/7; 141/8; 141/9; 141/65; 141/67; 141/100

(58) Field of Search ..... 141/1, 4–9, 11, 141/44–48, 63–67, 82, 94, 95, 99, 100, 198, 291, 324, 382, 383; 137/893, 895; 165/95; 134/166 R, 169 A; 123/41.14

(56) References Cited

U.S. PATENT DOCUMENTS

| | | | | |
|---|---|---|---|---|
| 4,109,703 | A | | 8/1978 | Babish et al. |
| 4,176,708 | A | | 12/1979 | Joffe |
| 4,178,134 | A | | 12/1979 | Babish et al. |
| 4,209,063 | A | | 6/1980 | Babish et al. |
| 4,293,031 | A | | 10/1981 | Babish et al. |
| RE31,274 | E | | 6/1983 | Babish et al. |
| 4,791,890 | A | | 12/1988 | Miles et al. |
| 4,793,403 | A | | 12/1988 | Vataru et al. |
| 4,809,769 | A | | 3/1989 | Vataru et al. |
| 4,899,807 | A | | 2/1990 | Vataru et al. |
| 4,901,786 | A | | 2/1990 | Vataru et al. |
| 5,078,866 | A | | 1/1992 | Filowitz et al. |
| 5,306,430 | A | * | 4/1994 | Dixon et al. ..... 210/712 |
| 5,390,636 | A | | 2/1995 | Baylor et al. |

* cited by examiner

*Primary Examiner*—Timothy L. Maust
(74) *Attorney, Agent, or Firm*—Gray Cary Ware & Freidenrich LLP

(57) ABSTRACT

A high-speed cleaning system and method in which a liquid is injected by-compressed air into the vacuumed chambers in the automotive cooling systems, in water-cooled engines. The liquid is injected in short period time under pressure, and the cooling system is pre-evacuated and held at a vacuum so that there is no flow restriction to build up high pressure in the cooling system in the short period of time the liquid is injected in the cooling system, and the liquid travels through the cooling system at a high rate of speed. High pressure air is mixed with the liquid before it is injected into engine cooling system, where the liquid/air mixture travels at a high rate of speed creating a hurricane type effect that breaking loose contaminants such as dirt, rust, and other particles and washes them out of the engine cooling system.

26 Claims, 20 Drawing Sheets

HIGH SPEED ENGINE COOLANT FLUSH AND FILTRATION SYSTEM AND METHOD

This application claims the benefit of U.S. Provisional Application No. 60/144,611, filed Jul. 20, 1999, and entitled Injected Liquid Wash in Vacuumed Chambers System.

FIELD OF THE INVENTION

The present invention relates to flushing of liquid cooling systems, and more particularly to a system and apparatus for quickly evacuating, cleaning and refilling a liquid cooling system such as an engine cooling system.

BACKGROUND OF THE INVENTION

It is well known that over time, contaminants such as rust, scale, particulates and sludge build up in liquid cooling systems such as engine cooling systems. These contaminants get baked onto cooling system components, reducing the efficiency and lifetime of cooling system components. Periodically, not only does the liquid coolant need replacement, but also the coolant system itself should be flushed to remove some of the contamination deposited throughout the cooling system.

Unfortunately, most commercially available coolant flushing systems fail to provide a cleaning action inside the chambers, hoses and other cooling system components to adequately remove interior contamination. Simply running a coolant or cleaning fluid through the system fails to remove these baked on contaminants from the system. Even increasing the flow rate through the system has limited success because there is a limitation on the overall pressure that can safely be applied to the cooling system without damaging it. Even adding entrained gas bubbles to the flushing liquid has been proposed, but that simply does not create a cleansing action inside the cooling system that effectively removes the; contamination. Such flushing systems also fail to provide a convenient way of removing, : filtering, recycling and replenishing coolant for the cooling system, especially in a manner that minimizes coolant waste and hazardous spills.

There is a need for an apparatus and method that creates a superior cleansing action inside a liquid cooling system for removing contamination therein, and in a way that conveniently removes filters, recycles and replenishes coolant from the cooling system.

SUMMARY OF THE INVENTION

The present invention solves the aforementioned problems by providing an apparatus and method which utilizes a relatively high proportion of air in the flushing liquid, together with a vacuum applied to the outlet of the cooling system, to create a high speed hurricane-like effect for effectively removing contamination within the cooling system.

The apparatus for flushing contaminants from a liquid coolant circulation system includes an injection hose connectable to an injection point of the coolant circulation system, an evacuation hose connectable to an extraction point of the coolant circulation system, a liquid supply for supplying liquid under pressure to the injection hose and the injection point, a vacuum motor connected to the evacuation hose for applying a vacuum to the evacuation hose and the extraction point, a gas inlet for receiving compressed gas and for mixing the compressed gas with the liquid supplied by the liquid supply to form a liquid and gas mixture. The liquid and gas mixture enters the coolant circulation system at the injection point, travels through the coolant circulation system at a high rate of speed, and is extracted from the coolant circulation system at the extraction point by the evacuation hose.

In another aspect of the present invention, the apparatus for flushing contaminants from an internal combustion engine cooling system, which includes a cooling radiator and a heating radiator both connected to an engine block with liquid coolant lines comprises an injection hose terminating in an injector that is connectable to the engine block to define an injection point into the engine cooling system, an evacuation hose terminating in a connector assembly that is connectable to one of cooling radiator and the heating radiator to define a first extraction point from the engine cooling system, a liquid supply for supplying liquid under pressure to the injection hose and the injection point, a vacuum motor connected to the evacuation hose for applying a vacuum to the evacuation hose and the first extraction point, a gas inlet for receiving compressed gas and for mixing the compressed gas with the liquid supplied by the liquid supply to form a liquid and gas mixture. The liquid and gas mixture enters the engine cooling system at the injection point, travels through the engine block and heating radiator and cooling radiator at a high rate of speed, and is extracted from the engine cooling system at the extraction point by the evacuation hose.

In one additional aspect of the present invention, the method of the present invention for flushing contaminants from an internal combustion engine cooling system, which includes a cooling radiator and a heating radiator both connected to an engine block with liquid coolant lines and points of injection and extraction, comprises the steps of mixing a liquid with a gas to create a liquid/gas mixture, injecting the liquid/gas mixture into an injection point of the engine cooling system under pressure and applying a vacuum to an extraction point of the engine cooling system to evacuate the liquid/gas mixture through the extraction point.

Other objects and features of the present invention will become apparent by a review of the specification claims and appended figures.

DETAILED DESCRIPTION OF THE PREFERRED EMBODIMENTS

Figure 1:
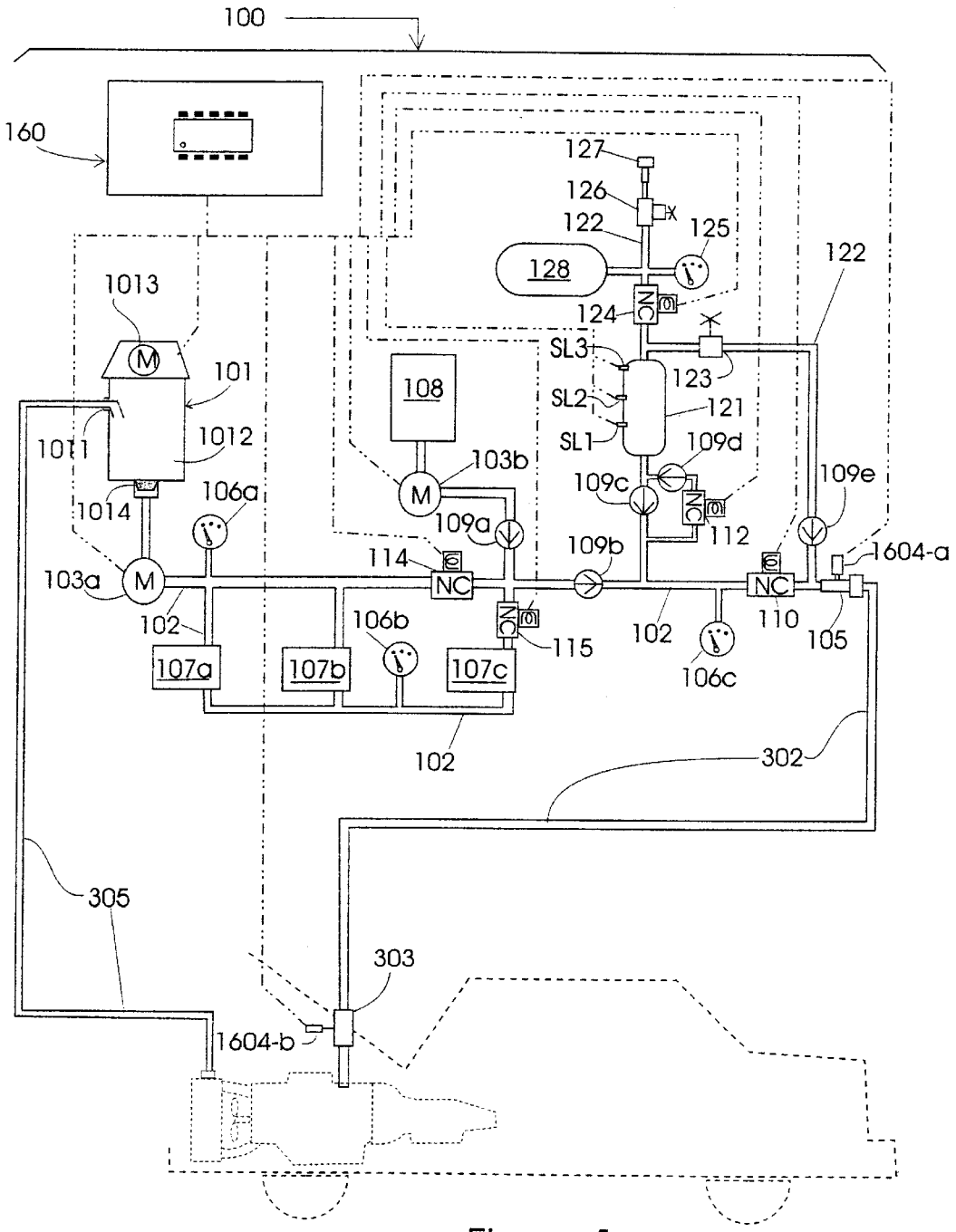
FIG. 1 is a plan view of the flush and filtration system of the present invention.

The present invention is a mobile liquid injection flush and filtration system 100, as illustrated in FIG. 1, for cleaning liquid cooling systems (i.e. a car engine cooling system), and filtering and recycling coolant fluid.

Figure 24:
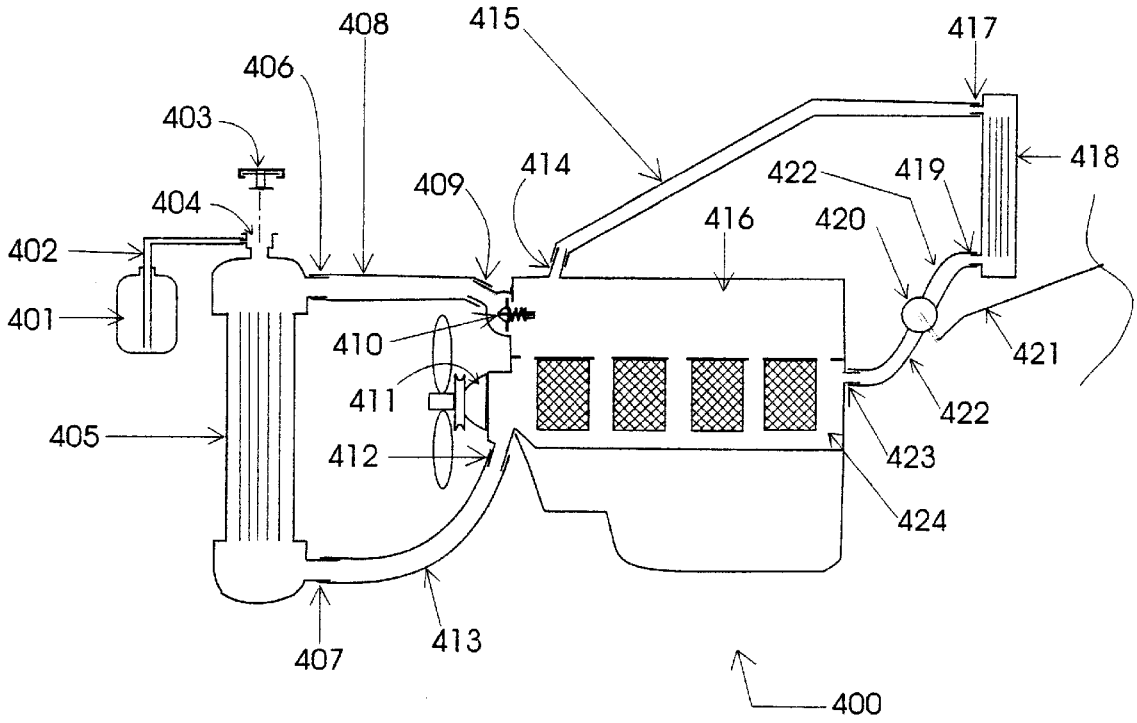
FIG. 24 is a plan view of a conventional internal combustion engine cooling system 400.

A typical internal combustion engine cooling system is illustrated in FIG. 24, and includes a coolant recover tank 401, an overflow hose 402, a radiator cap 403, a coolant filler 404, a radiator 405, an upper hose neck 406, a lower hose neck 407, an upper radiator hose 408, a thermostat housing 409, a thermostat 410, a water pump 41 a water pump coolant inlet 412, a lower radiator hose 413, a heater return inlet 414, a heater return hose 415, cylinder head coolant chambers 41.6, a heater return outlet 417, a heater core 418, a heater inlet 419, a heater control valve 420, a heater control line 421, a heater inlet hose 422, a hot water outlet 423, and engine block coolant chambers 424, all configured as illustrated in FIG. 24.

Figure 3A:
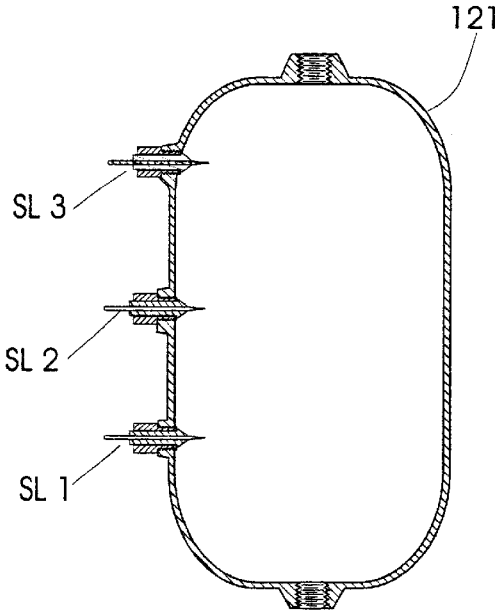
FIG. 3A is aside cross-sectional view of the liquid pre-charge tank 121.
Figure 3B:
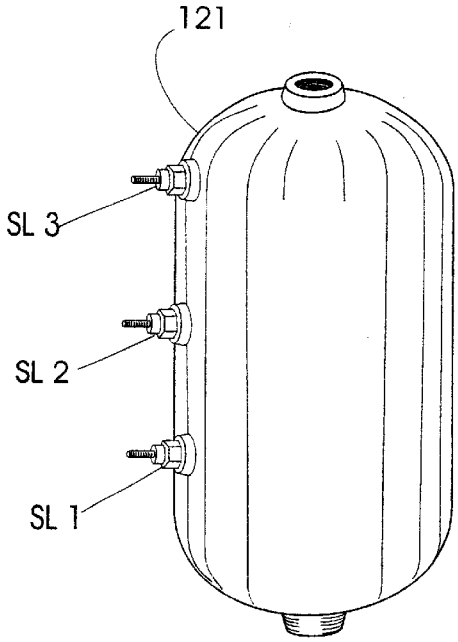
FIG. 3B is a perspective view of the liquid pre-charge tank 121.
Figure 4A:
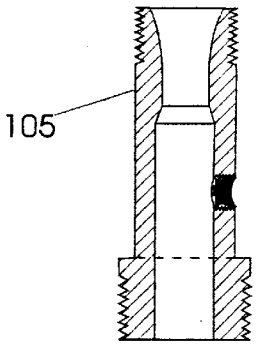
FIG. 4A is a side cross-sectional view of outlet fitting 105.
Figure 4B:
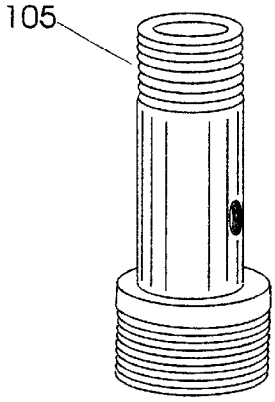
FIG. 4B is a side view of outlet fitting 105.
Figure 10:
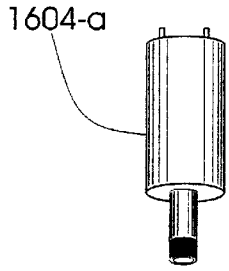
FIG. 10 is a side view of pressure switch 1604-*a*.
Figure 5A:
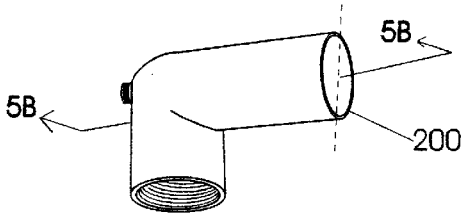
FIG. 5A is a perspective view of vacuum joint 200.
Figure 8A:
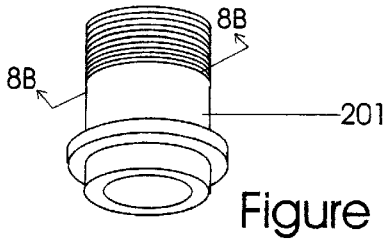
FIG. 8A is a perspective-view of radiator filler adapter 201.
Figure 5B:
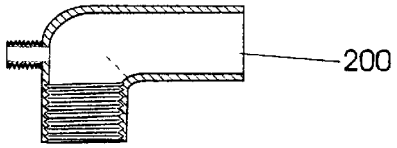
FIG. 5B is an cross-sectional view of vacuum joint 200.
Figure 8B:
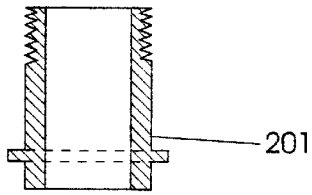
FIG. 8B is a side cross-sectional view of radiator filler adapter 201.
Figure 6:
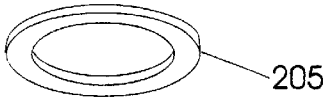
FIG. 6 is a perspective view of seal 205.
Figure 9A:
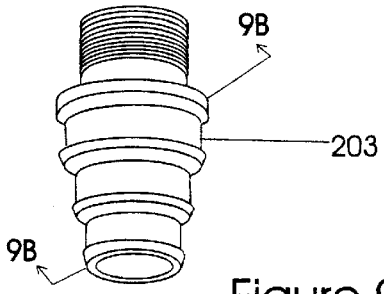
FIG. 9A is a perspective view of radiator hose adapter 203.
Figure 7A:
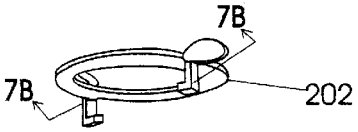
FIG. 7A is a perspective view of retainer 202.
Figure 7B:
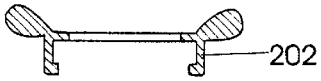
FIG. 7B is a side cross-sectional view of retainer 202.
Figure 9B:
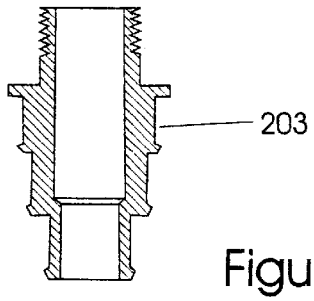
FIG. 9B is a side cross-sectional view of radiator hose adapter 203.
Figure 11A:
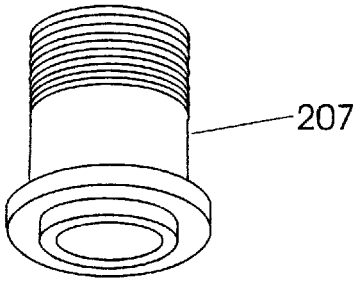
FIG. 11A is a perspective view of thread type filler adapter body 207.
Figure 11B:
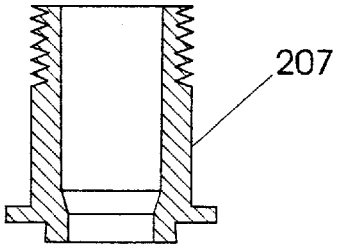
FIG. 11B is a side cross-sectional view of thread type filler adapter body 207.
Figure 13:
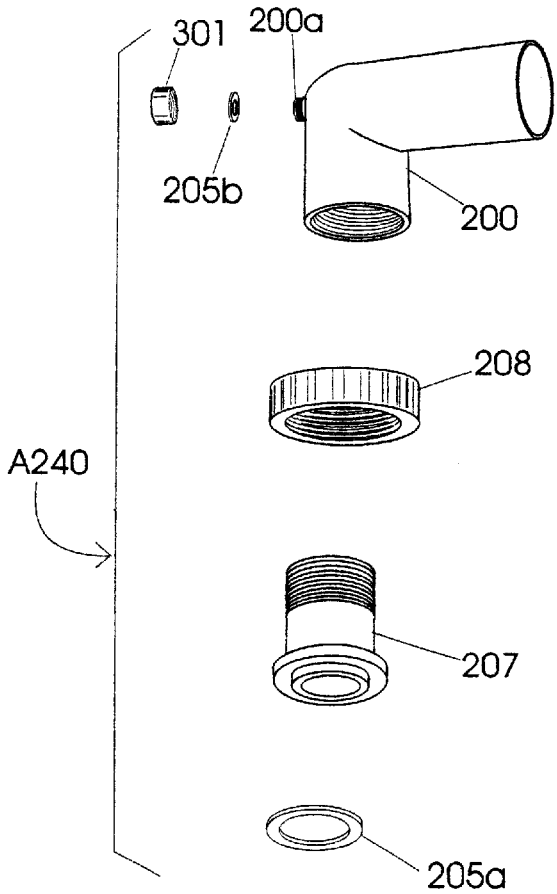
FIG. 13 is an exploded perspective view of vacuum adapter assembly A240.
Figure 12A:
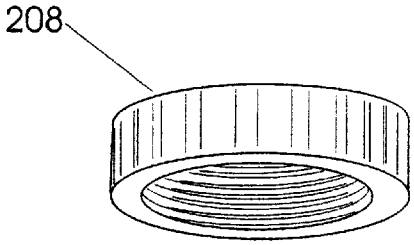
FIG. 12A is perspective view of thread type filler adapter female cap 208.
Figure 12B:
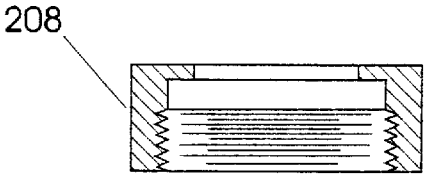
FIG. 12B is side cross-sectional view of thread type filler adapter female cap 208.
Figure 14:
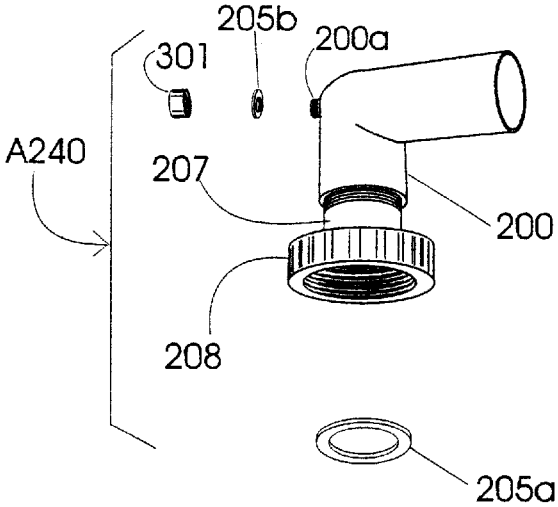
FIG. 14 is a partially exploded perspective view of vacuum adapter assembly A240.
Figure 15A:
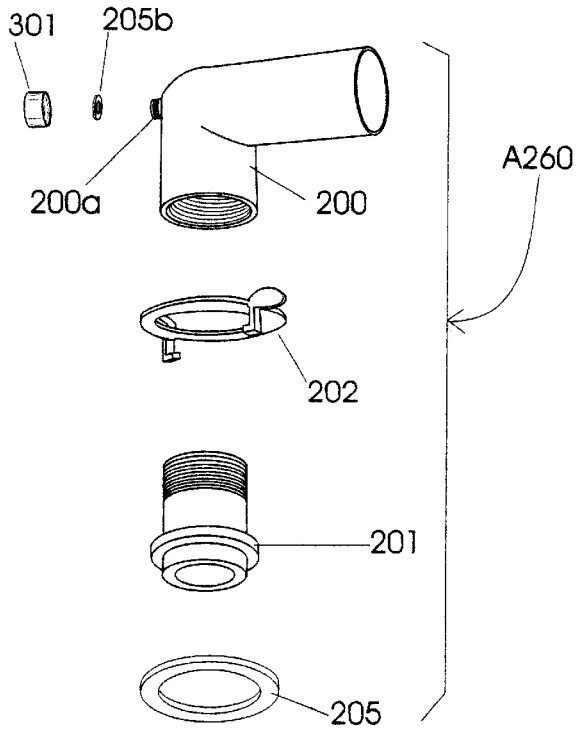
FIG. 15A is an exploded view of vacuum adapter assembly A260 for connection to a radiator filler.
Figure 15B:
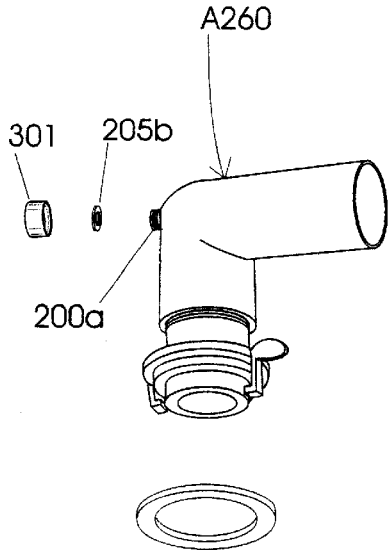
FIG. 15B is a partially exploded view of vacuum adapter assembly A260 for connection to a radiator filler.
Figure 16A:
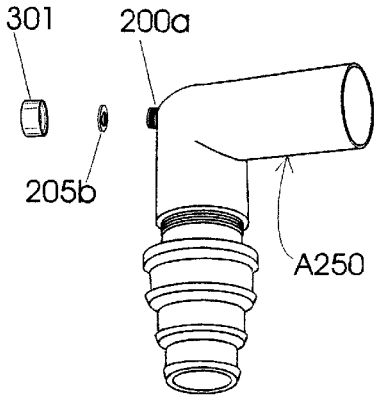
FIG. 16A is a partially exploded view of vacuum assembly A250, for connection to a radiator hose.
Figure 16B:
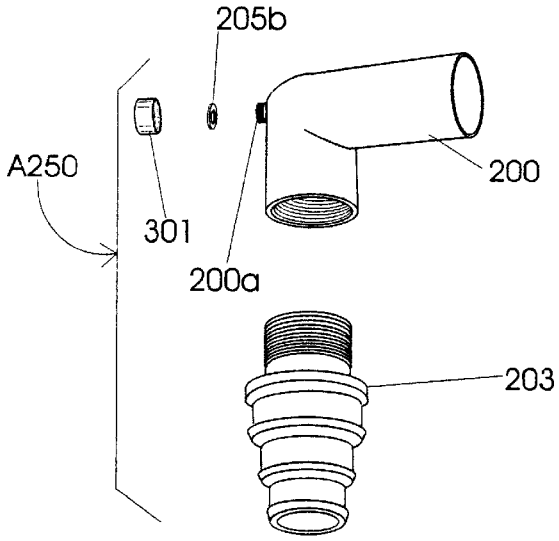
FIG. 16B is an exploded view of vacuum assembly A250 for connection to a radiator hose.
Figure 17A:
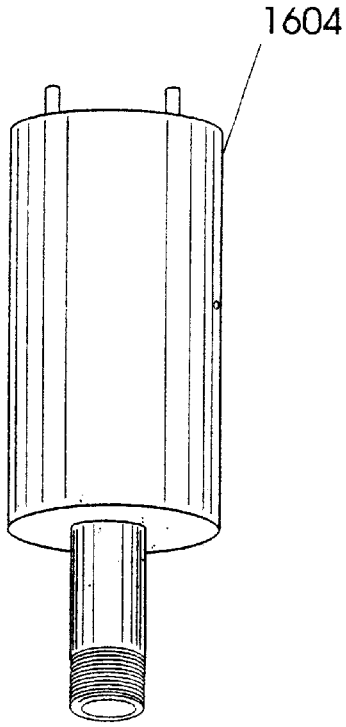
FIG. 17A is a perspective view of pressure switch 1604.
Figure 17B:
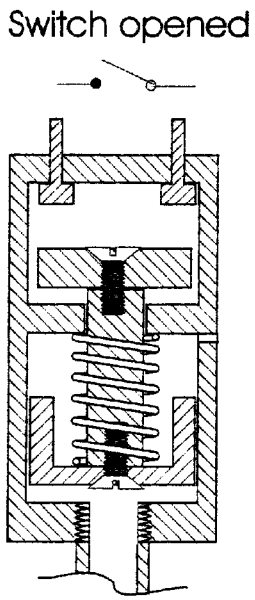
FIG. 17B is a cross-sectional view of pressure switch 1604, with the switch in its open position.
Figure 17C:
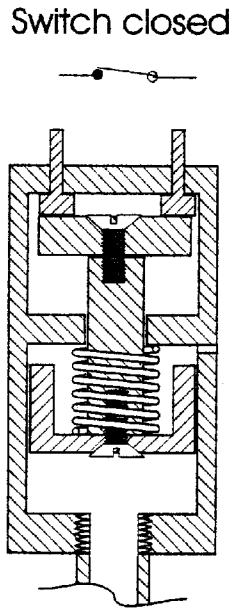
FIG. 17C is a cross-sectional view of pressure switch 1604, with the switch in its closed position.
Figure 18A:
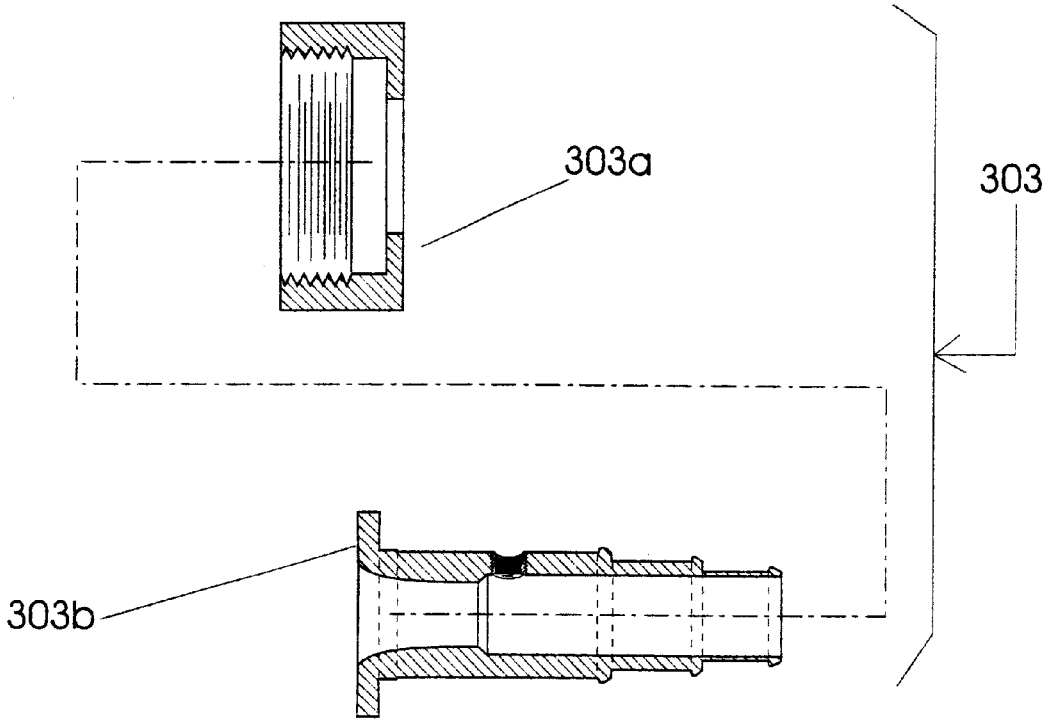
FIG. 18A is a exploded cross-sectional view of injector nozzle assembly 303.
Figure 18B:
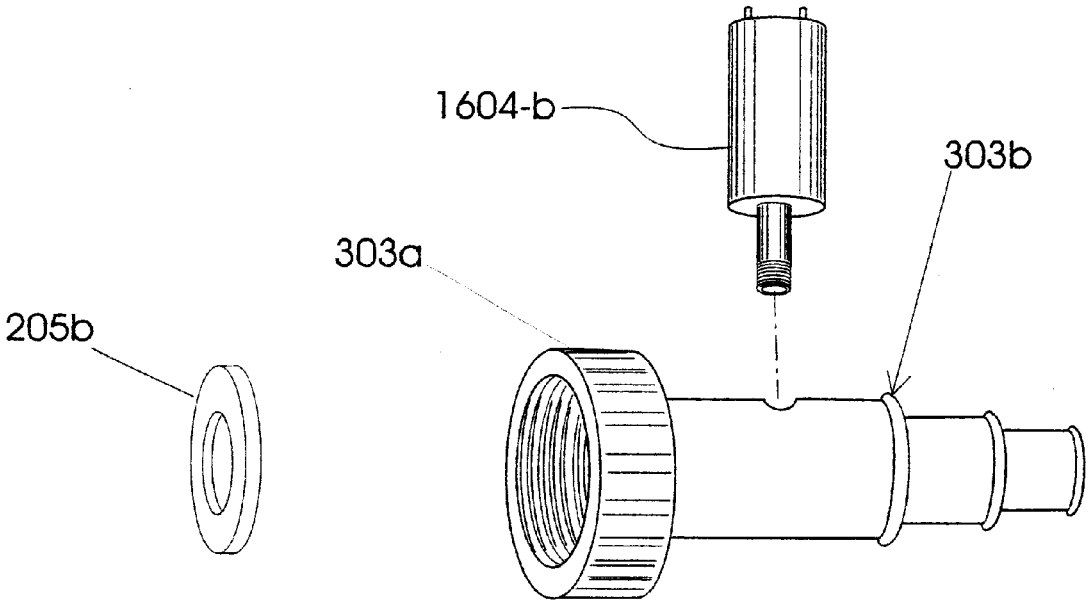
FIG. 18B is a perspective exploded view of injector nozzle 303 assembly with pressure switch 1604*b*.
Figure 19:
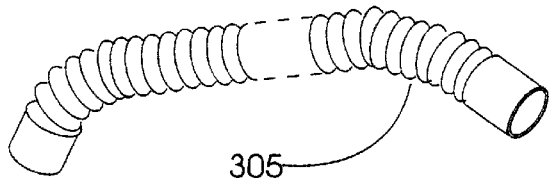
FIG. 19 is a partial perspective view of vacuum hose 305.
Figure 20A:
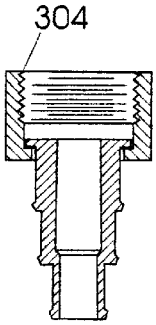
FIG. 20A is a side cross-sectional view of heater hose adapter 304.
Figure 20B:
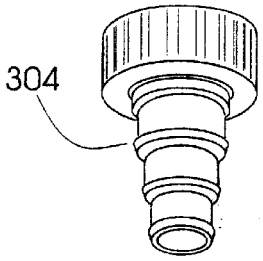
FIG. 20B is a perspective view of heater hose adapter 304.

The liquid flush and filtration system 100 of the present invention (best illustrated in FIG. 1) includes a vacuum assembly 101 (comprising a liquid/air vacuum motor 1013 and tank 1012), liquid pumps 103*a* and 103*b*; filters 107*a*, 107*b*, 107*c*; a coolant tank 108; one-way valves 109*a*, 109*b*, 109*c*, 109*d*, 109*e*; pressure gauges 106*a*, 106*b* and 106*c*; electrically controlled valves (filter bypass valve 114, filter control valve 115, outlet cut-off valve 110, pre-charge control valve 112, and air control valve 124); a liquid pre-charge tank 121 that includes level sensors SL1, SL2, SL3 (see FIG. 3); an adjustable air bypass valve 123; an adjustable air pressure regulator 126; an air reserve tank 128, a compressed air inlet 127; and pressure sensors 1604-*a* and 1604-*b* (see FIGS. 10 and 17A–C); all connected together as shown in FIG. 1 using pipes 102 and 122. An electrical contrller 160 operates, and receives data from, the electrical devices as shown in FIG. 1.

Figure 21A:
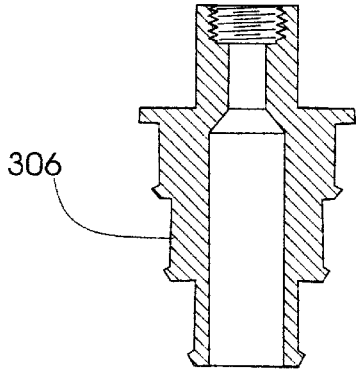
FIG. 21A is a side cross-sectional view of large hose adapter 306.
Figure 21B:
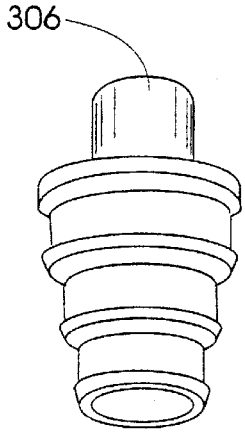
FIG. 21B is a perspective view of large hose adapter 306.
Figure 22:
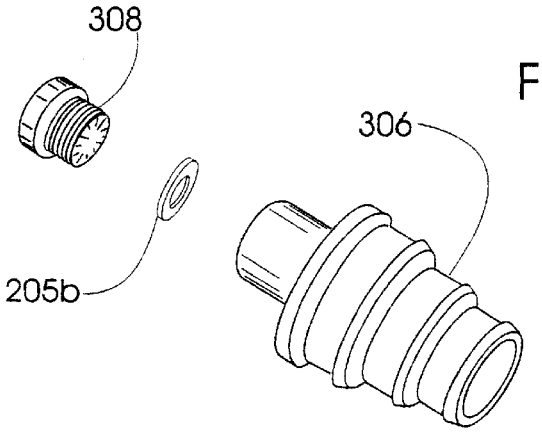
FIG. 22 is an exploded view of hose plug 308, seal 205*b* and hose adapter 306 .
Figure 23A:
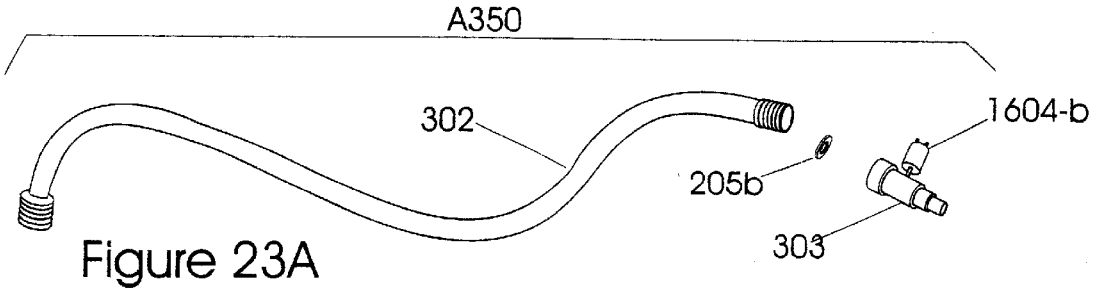
FIG. 23A is an exploded view of output hose assembly A350.
Figure 23B:
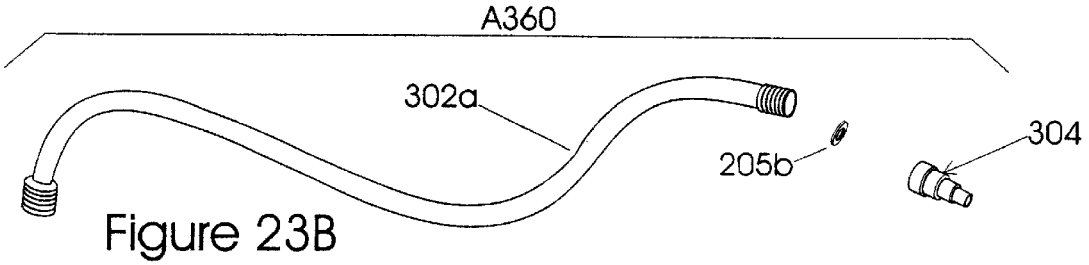
FIG. 23B is an exploded view of vacuum hose assembly A360.
Figure 23C:
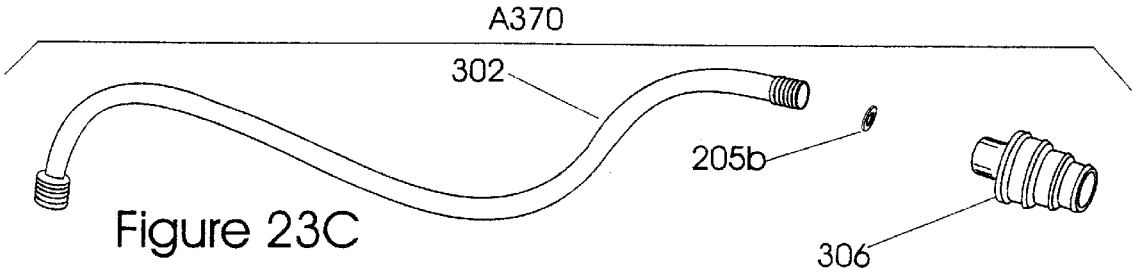
FIG. 23C is an exploded view of output hose assembly A370.
Figure 23D:
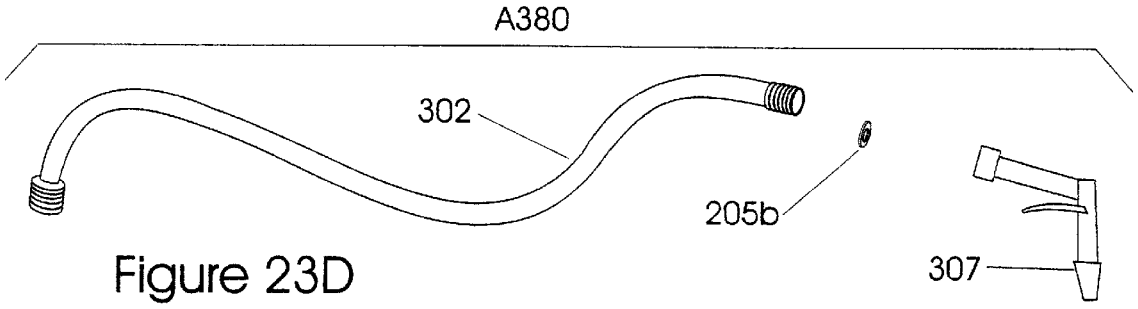
FIG. 23D is an exploded view of output hose assembly A380.

The flush and filtration system 100 includes an output assembly A350, A370 or A380 for connection to the engine cooling system (see FIGS. 23A, C and D). Each of these output assemblies include an output hose 302. and seal 205*b*. In output assembly A350, output hose 302 terminates in a liquid/air injector 303 assembly that includes a liquid/air injector 303*b* having a reduced diameter to accelerate liquid/air as it is injected into the engine cooling system (see FIGS. 18A–B 23A and 26–27), and a hose adapter 303*a* for attachment to output hose 302. Pressure sensor 1604-*b* inserts into injector 303*b* to measure the pressure therein. In output assembly A370, output hose 302 terminates in a hose plug 306 having a plurality of outer diameters to attach to the engine cooling system (FIGS. 21 A–B, 23C and 28), or hose plug 306 can be sealed by a plug 308 (FIG. 22) for temporarily sealing the thermostat housing 409 (see FIG. 27). In output assembly A380, output hose 302 terminates in a hand held liquid control valve 307 for manually and selectively filling the engine cooling system (FIGS. 23D and 29) or an external container (FIG. 30) with liquid coolant.

Flush and filtration system 100 further includes a vacuum hose 305 attached to tank 1012 that terminates in a vacuum assembly A240, A250 or A260 for connection to (and liquid/air evacuation from) the engine cooling system (see FIGS. 1 and 25–29). Vacuum assembly A240 includes vacuum joint 200, seals 205*a* and 205*b*, cap 301 and coolant tank adapter 207/208 (see FIGS. 5–6 and 11–14), for connection to certain threaded coolant filler openings on some vehicles. Vacuum assembly A250 includes vacuum joint 200, seal 205*b*, cap 301 and radiator hose adapter 203 (see FIGS. 5A–B, 9A–B and 16A–B), for connection to the radiator and vacuum hose of the engine cooling system (see FIGS. 27–28). Vacuum assembly A260 includes vacuum joint 200, seals 205 and 205*b*, cap 301, retainer 202 and radiator filler adapter 201 (see FIGS. 5–8 and 16A–B), for connection to the radiator filler and vacuum hose of the engine cooling system (see FIGS. 25–26). Cap 301 seals off vacuum joint aperture 200*a* when not attached to hose 302*a* (as further explained below).

Hose assembly A360 includes hose 302*a* that terminates in a hose adapter 304 having a plurality of outer diameters for connection to various diameters of heater hoses found in engine cooling systems (FIGS. 20, 23B and 26–27). The input of hose 302*a* attaches to vacuum joint aperture 200*a* in certain configurations (see FIGS. 26 and 27).

Electrical Control Circuit

The basic operation of the engine cooling system 100 is as follows. The engine cooling system is pre-evacuated by applying both pressurized air and a vacuum to the engine cooling system. The liquid pre-charge tank 121 is filled up with coolant, which is then mixed with pressurized air and injected into the cooling system. The liquid/air mixture rushes through the cooling system and is evacuated using a vacuum applied to the point(s) of extraction. The system can recycle the evacuated coolant by filtration and re-injection. A more detailed description of the system operation is discussed in the next section.

Figure 2A:
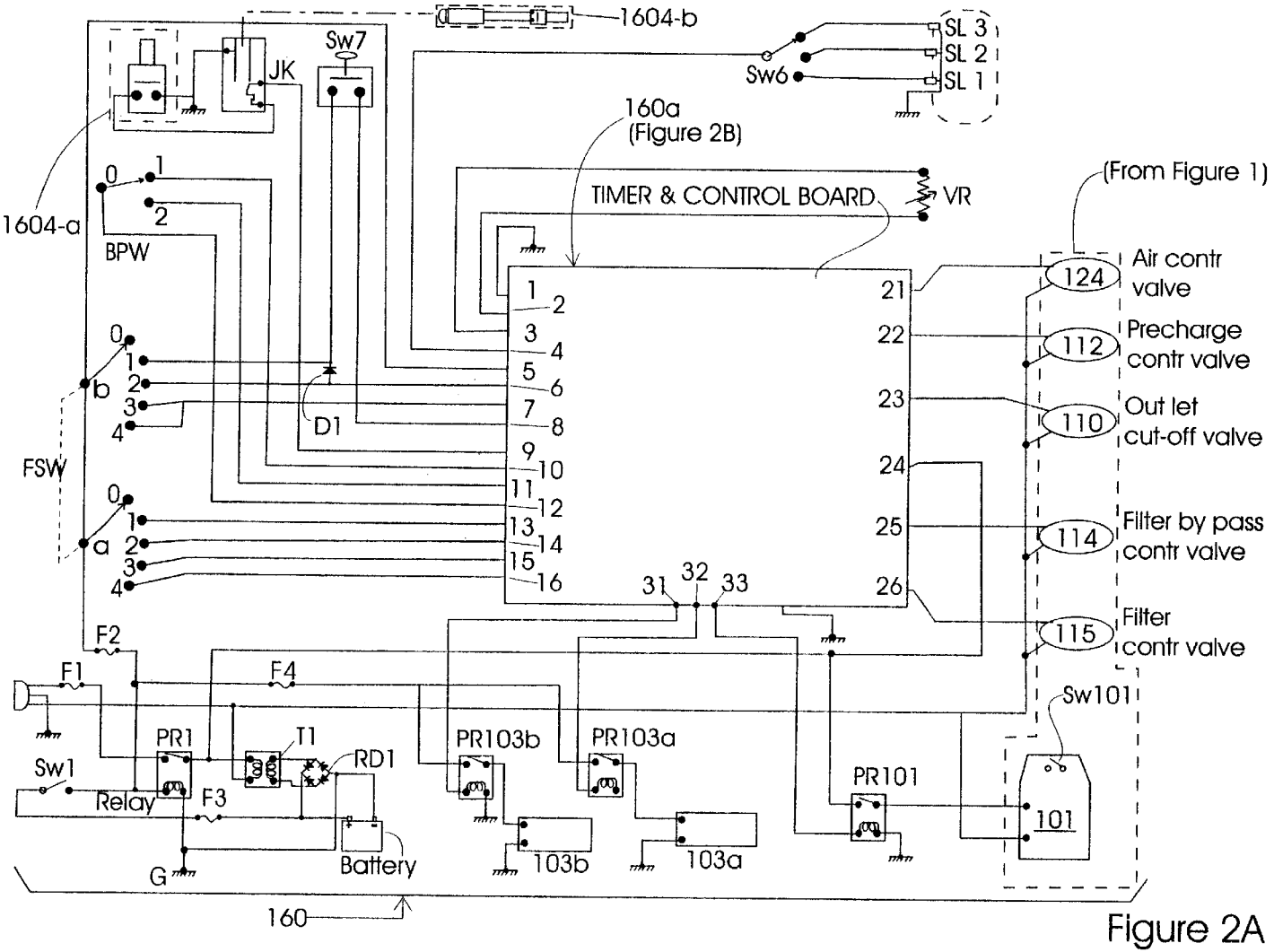
FIG. 2A is a schematic diagram of the overall flush and filtration system of the present invention.
Figure 2B:
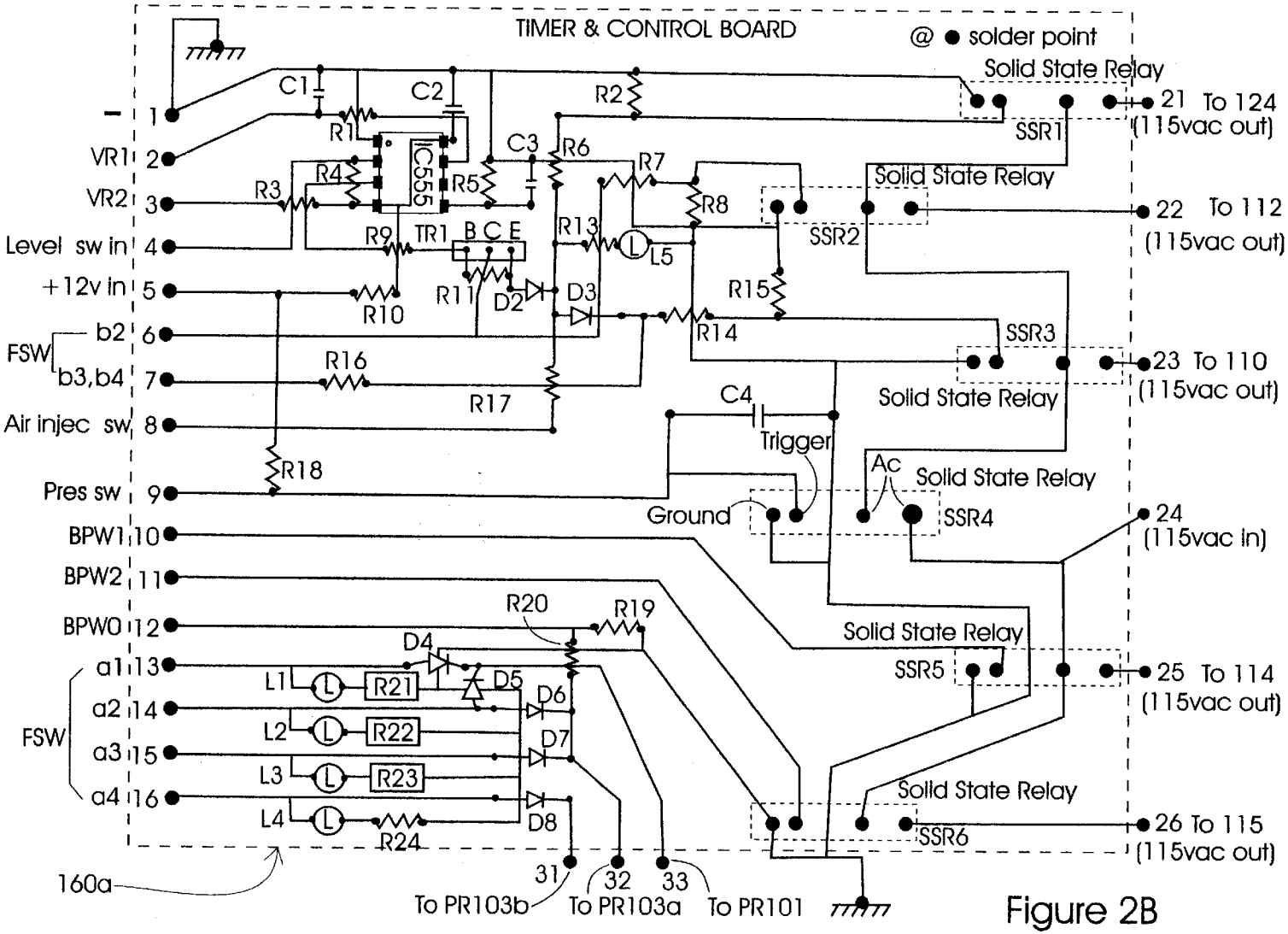
FIG. 2B is a schematic diagram of the timer and control board circuit.
Figure 2C:
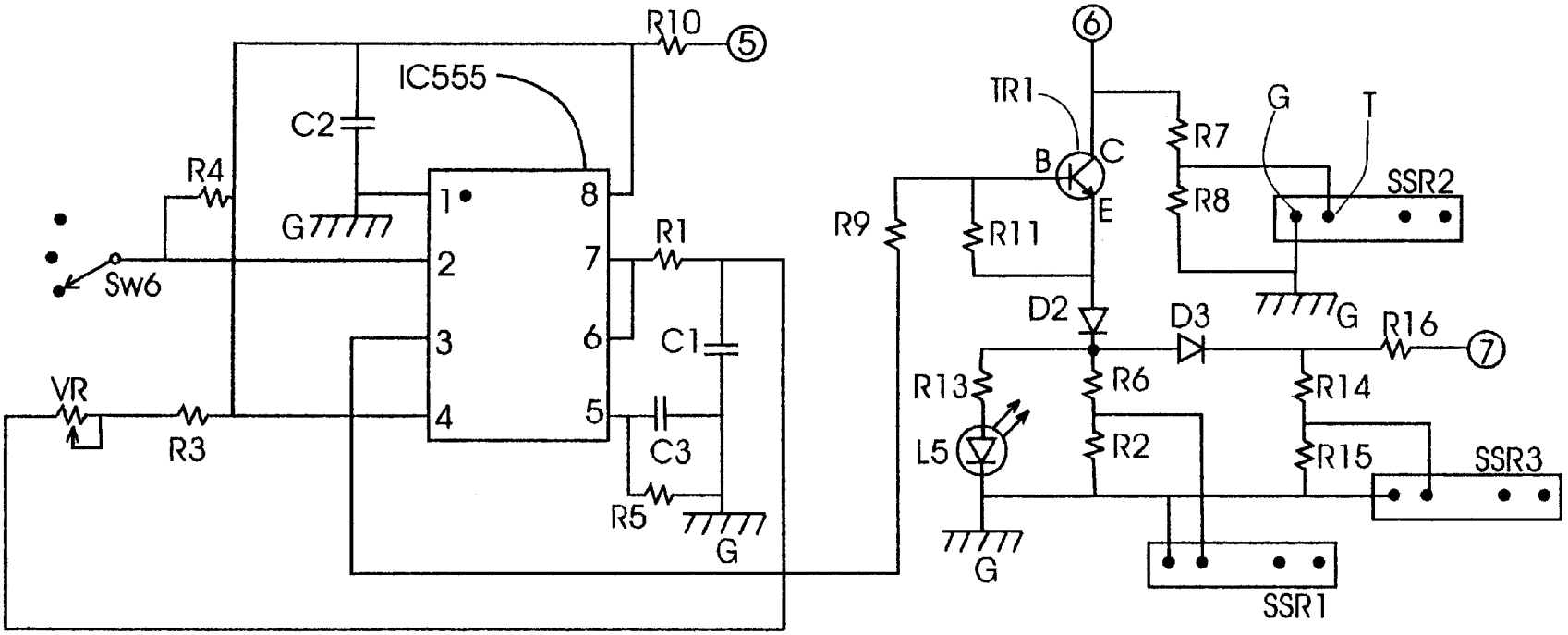
FIG. 2C is a schematic diagram of the timer circuit.

The electrical control circuitry of controller 160 is shown in FIGS. 2A–2C. AC power is supplied through the power plug PLG and through fuse F1, which is a shock circuit breaker for AC power circuit protection. PR1 is a main power relay, connecting power from F1 to transformer T1; vacuum union power relay PR10, and all the electrical control valves 124, 112, 110, 114, and 115. The control valves 124, 112, 110, 114, 115 are controlled by control board 160*a* (see FIGS. 2A and 2B).

A 12 volt DC power source (battery BAT) provides power for the control circuitry (function switch FSW and control board 160*a*), and two DC power liquid pumps 103*a* and 103*b*. Battery BAT is recharged by transformer T1 and rectifier RD1. A main DC power protection fuse F3 is connected between battery BAT and a main power control switch SW1 which controls AC power relay PR1 and all the control-circuits. Switch SW1 connects F3 to main power relay PR1, fuse F2 and fuse F4. Fuse F2 is a control-circuit protection fuse connecting function switch FSW to timer and control board 160*a* (see FIG. 2B). Fuse F4 is a protection fuse for liquid pumps 103*a* and 103*b* and relays PR103*a* and PR103*b*.

When switch SW1 is "off", the electrical control is disabled. When SW1 is "on",the DC power is supplied to relay PR1, and AC power is "on" so the battery BAT begins to charge up and AC power is applied to relay PR101 and to lead 24 of control board 160*a*. DC power is applied to relays PR103*b* and PR103*a*, and to function switch FSW. Also, DC power is applied to control board 160*a*, through resistor R18, to provide a 1.2 DC voltage to turn on solid state relay SSR4. Also, DC power supplied through resistor R10 on control board 160*a* provides power for timer IC555. C2 is a power stabilizer capacitor to prevent interrupted signal, and resistor R4 provides high voltage to keep the trigger in timer IC555 in its "off" condition. With function switch FSW in the "0" position, all the functions are inactive.

1. Evacuating Functions

When function switch FSW is moved to its on "1" position, then main switch SW1 is turned "on", the 12 volt power from the al terminal of switch FSW is applied to lead 13 of control board 160*a*, through diode D4 and to lead 33, which connects to vacuum power relay PR101 to turn on the motor 1013 in vacuum assembly 101 for applying a vacuum to the engine cooling system. Indicator light L1 is also lit. Resistor R21 is voltage reducer resistor. Diode D5 does not allow current from diode D4 to pass to lead 14, so there is no power supplied to indicator light L2 and PR103*a*. With function switch FSW selected to terminal b1, power is applied to menu air injection switch SW7, wherein diode D1 (in FIG. 2A) prevents any current from passing to and activating the b2 terminal circuit. When switch SW7 is pressed, DC power passes to lead 8 of control board 160*a*, and on through resistor R17, diode D3 and resistor R14. Resistors R14 and R15 form a voltage divider to provide a 1.2 volt at the trigger of relay SSR3, which actives relay SSR3 to supply 115 volt AC power to cut-off valve 110, opening the valve. Current from R17 passes through resistor R13 and activates indicator light L5. Current from R17 also passes through resistors R6 and R2 and on to ground. The voltage at the trigger of relay SSR1 is 1.2 volts, so that when relay SSR1 is activated, 115 volt AC power is applied air control valve 124 to inject air into to engine cooling system. The high speed air from air control valve 124 blows coolant out of the engine cooling system as further described below under system operation. When evacuation is complete, switch SW7 is released.

2. Cleaning Function

The cleaning operation is an automatic function using the level sensors SL1–SL3 and a timer circuit to start and stop liquid/air injection. Timer IC555 is used in the timer control circuit (FIG. 2C), where pin I is ground, pin 2 is trigger, pin 3 is output, pin 4 is reset, pin 5 is control voltage, pin 6 is threshold, pin 7 is discharge, and pin 8 is power supply (4.5v to 15v).

When function switch FSW is turned to position "2",then main switch SW1 is turned "on", and the DC power from pin a2 of function switch FSW is supplied to lead 14 of control board 160*a*, lamp L2 and resistor R22 and on to ground, which lights up indicator light L2. Diode D4 isolates power from D5 and pin 13. Current passes through diode D5 and on to lead 33 of control board 160*a* to activate relay PR101 which turns on vacuum assembly 101. Also, current passes through diode D6 and lead 32 of control board 160*a* to activate the relay PR103*a*, which turns on liquid pump 103*a*. Diode D7 isolates power from leads 32 and 15 of control board 160*a*. Also power from diode D6 passes through resistors R20 and R19 and on to ground, whereby 1.2 volts are applied to lead 12 of control board 160*a*, which then goes to filter bypass switch BPW.

Bypass switch BPW can be selected to filter the liquid or to bypass the filters when filling liquid precharge tank 121 from tank 1012. To filter liquid from liquid pump 103*a*, bypass switch BPW is moved to position "2",whereby 1.2 volts is applied to lead 11 of control board 160*a* to activate relay SSR6, which closes the filter bypass control valve 114. With filter control valve 115 opened, liquid pumped from pump 103*a* passes through filters 107*a* and 107*b*, and filter 107*c* (see FIG. 1), then through valve 115, one way valve 109*b*, pre-charge control valve 112, one way valve 109*d* and then into liquid pre-charge tank 121. To bypass filtering of liquid from pump 103*a*, bypass switch BPW is moved to position "1", whereby 1.2 volts is applied to lead 10 of control board 160*a* to activate relay SSR5, which opens filter bypass valve 114 and closes filter control valve 115. No liquid can pass through filters 107*a–c*, and liquid from pump 103*a* will go directly to one way valve 109*b*, precharge control valve 112, one way valve 109*d* and into liquid pre-charge tank 121.

When function switch FSW is positioned on pin b2 thereof, DC power is delivered to lead 6 of control board 160*a*, and then to collector C of transistor TR1 (FIGS. 2B and 2C). Power is also applied to resistors R7 and R8, then goes to ground, whereby the trigger in relay SSR2 receives 1.2 volts which actives SSR2 to open liquid pre-charge control valve 112 so that liquid from pump 103*a* can fill liquid pre-charge tank 121. The DC power from switch SW1 is applied to lead 5 of control board 160*a*. Resistor R10 and capacitor C2 are a voltage stabilizer to avoid interrupted signals that trigger the timer, so capacitor C3 is discharged by pin 7 of IC555. Resistor R5 reduces the control voltage, so that when the liquid in the liquid pre-charge tank 121 has not reached selected level (i.e. the level sensors SL1–SL3 are open), resistor R4 applies a voltage to pin 2 of timer IC555 and the timer IC555 stays in an "off" condition. When the liquid in tank 121 fills up to the selected level, the appropriate level sensor SL1, SL2, or SL3 is grounded by water and the voltage at pin 2 of timer IC555 drops to 0, whereby the timer is triggered. Discharge pin 7 is then off (open to ground), and current from resistor R10 passes through resistor R3 and variable resistor VR to begin charging up capacitor C1. Variable resistor VR adjusts the charge time from 5 seconds to 20 seconds. When capacitor C1 charges up to a voltage equivalent to that of pin 5 of timer IC555, the threshold at pin 6 of timer IC555 turns off the timer and turns on discharge (closed to ground) t pin 7 of timer IC555, whereby capacitor C1 discharges again, and pin 4 of timer IC555 resets the timer which then waits for next trigger signal.

When the timer has been triggered, the output pin 3 0f timer IC555 goes high, and current goes through resistor R9 and to base B of TR1, whereby the gate of TR1 is opened and current from lead 6 of control board 106*a* passes through pins C and E of TR1, through diode D2 and resistor R13 and light L5 (which lights up light L5) and on to ground. This current also passes through resistors R6 and R2 and on to ground, whereby 1.2 volts is supplied to the trigger of relay SSR1, which turns on air control valve 124. The power from diodes D2 and D3, and resistors R14 and R15 then goes to ground, which activates relay SSR3 to turn on outlet cut-off valve 110, which causes air and liquid to be injected into the engine cooling system via output hose 302. Once all the liquid is injected, air is continually injected to evacuate engine cooling system. Then, the timer stops, valves 124 and 110 are closed, and pre-charge tank 121 is refilled with liquid.

If the pressure in engine cooling system is over the pressure limit during liquid/air injection, the pressure switches 1604-*a* or 1604-*b* sense the excessive pressure and ground lead 9 of control board 160*a*. The trigger voltage in relay SSR4 will then go to 0 volts, the relay SSR4 turns off AC power on relays SSR1, SSR2 and SSR3 so the valves 124, 112 and 110 will close immediately to cut off liquid/air injection flows. Resistor R118 reduces voltage from pin number 5 on timer and control board 160*a*, which provides 1.2 volts to the trigger of relay SSR4, which controls AC power to relays SSR1, SSR2 and SSR3. When pressure switches 1604-*a* or 1604-*b* are grounded, relay SSR4 will inactive. When pressure switches 1604-*a* and 1604-*b* are opened, power from lead 5 of control board 160*a* is applied through resistor R18 to capacitor C4, whereby the voltage in the trigger of relay SSR4 has a small delay to reach up to 1.2 volts while capacitor C4 charges up, which then re-actives relay SSR4, to prevent high frequency pressure vibrations.

The cleaning cycles over and over, until engine cooling system is clean (as further explained below). To stop all the functions, the user simply needs to just turn off the main power switch SW1.

3. Filling Coolant With Coolant in Vacuum Tank or Refiltering Over Old Coolant

When function switch FSW is moved to position "3" and switch SW1 is turned "on", the power from pin b3 is applied to lead 7 of control board 160*a*, through resistors R16, R14 and R15, and then on to ground. The diode D3 isolates the power from resistor R16 and diode D2, so that the trigger of SSR3 receives 1.2 volts of power to activate SSR3 to turn on outlet cut off control valve 110, which allows liquid to exit into the output hose 302. Power from pin a3 of function switch FSW is applied to lead 15 of control board 160*a*, whereby current passes through light L3 (which lights up) and R23, and then goes on to ground. Power also passes through diode D7 and lead 32 of control board 160*a*, to activate relay PR103*a* which in turn activates liquid pump 103*a*. Also, 1.2 volts is applied to lead 12 of control board 160*a*, whereby the bypass switch BPW can be positioned to filter control "on" for filtering or to bypass "on" to bypass filtering. Diode D6 isolates power to lead 14 of control board 160*a*.

Figure 28:
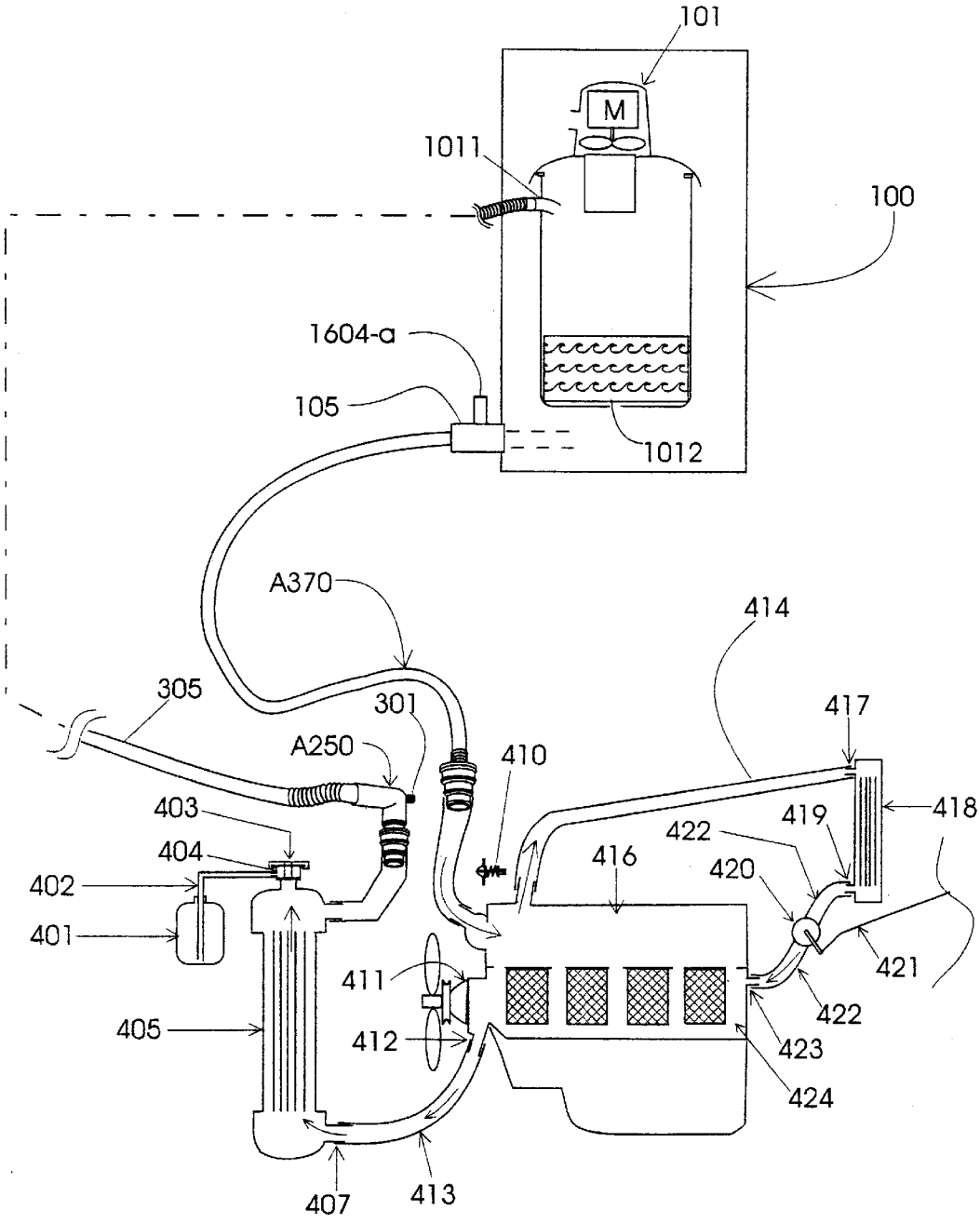
FIG. 28 is a cross-sectional plan view of the a third connection configuration of the flush and filtration system of the present invention to a conventional engine cooling system.
Figure 29:
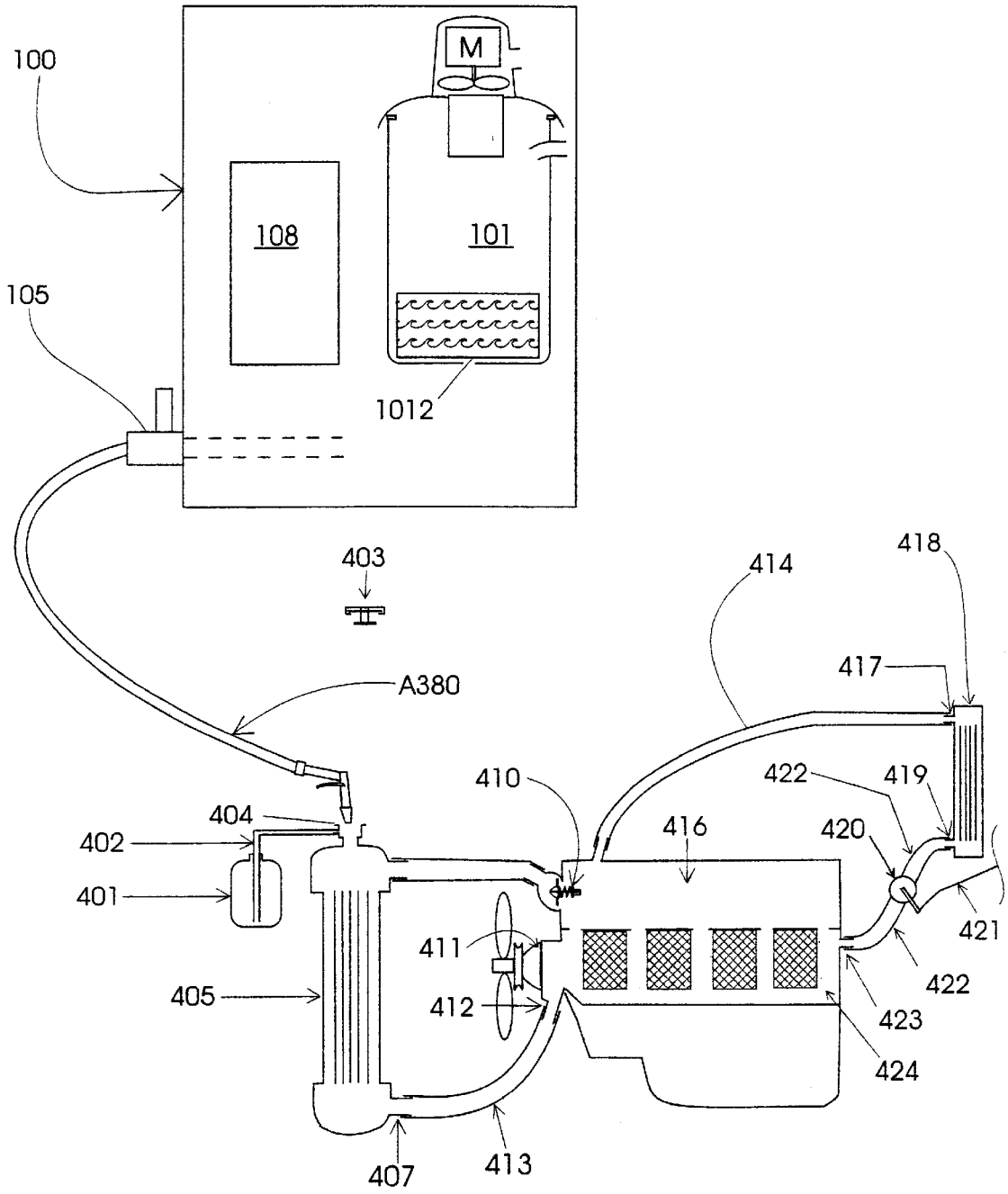
FIG. 29 is a cross-sectional plan view of the connection between the flush and filtration system of the present invention and a conventional engine cooling system, for refilling thereof.
Figure 30:
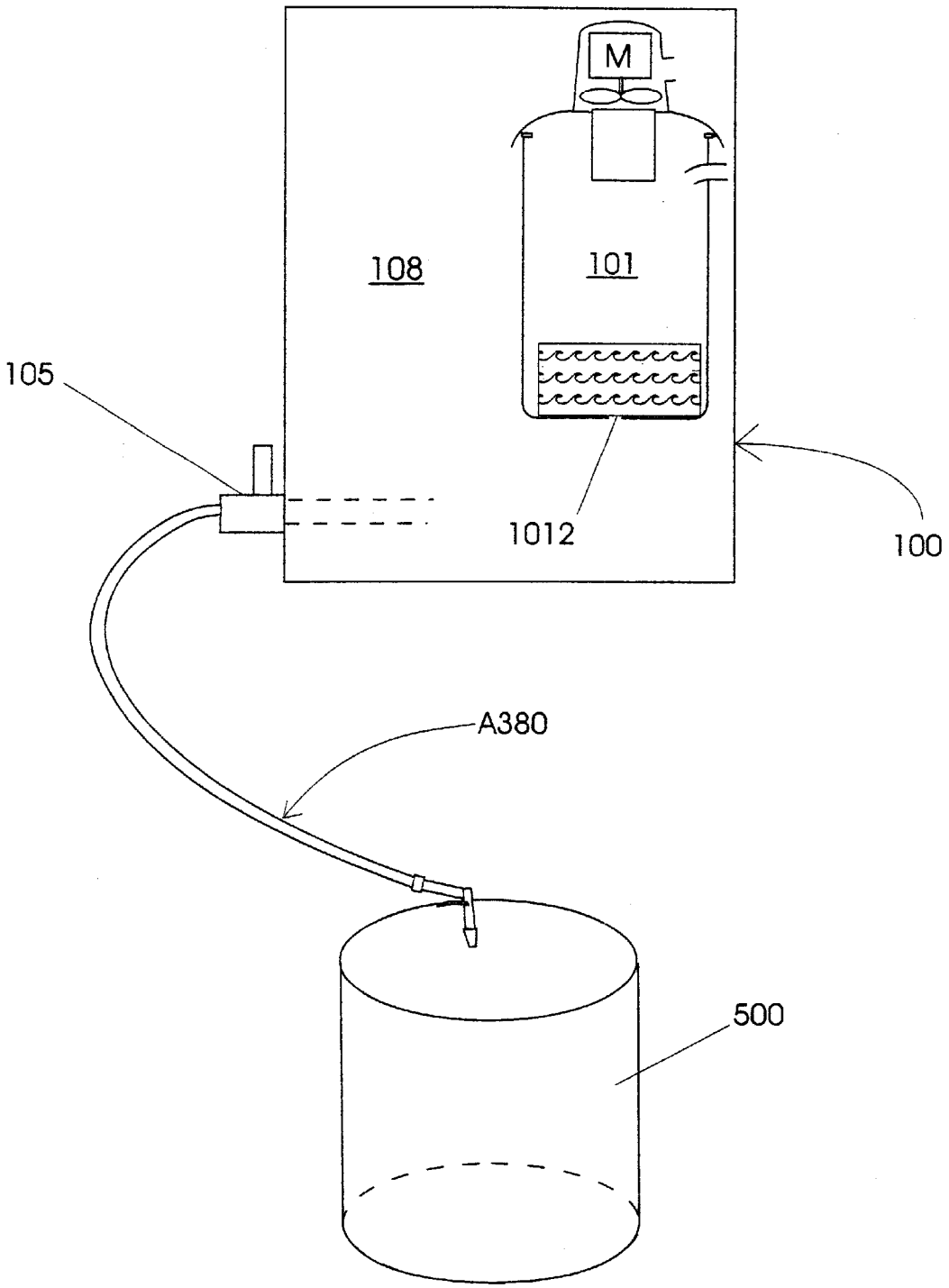
FIG. 30 is a cross-sectional plan view of the Mush and filtration system of the present invention for transfer of coolant to another container.
Figure 31:
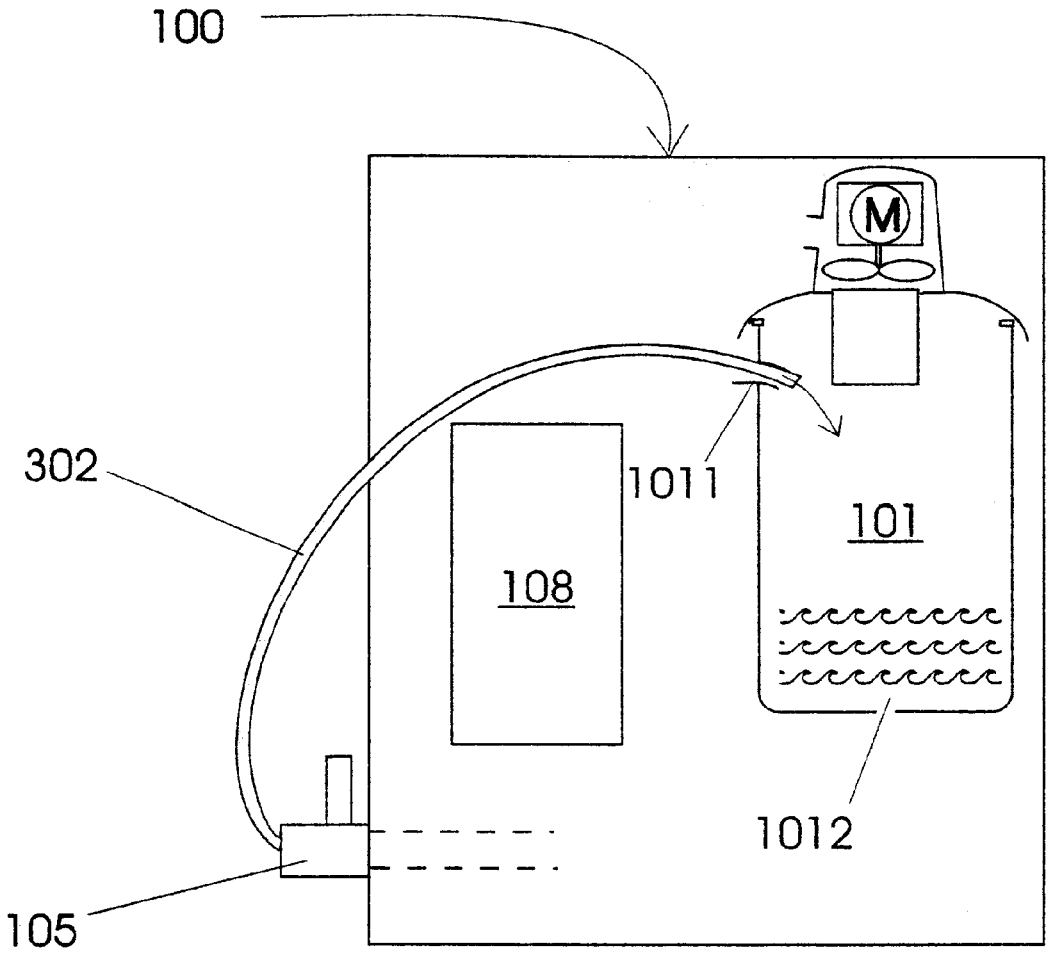
FIG. 31 is a cross-sectional plan view of the flush and filtration system configuration of the present invention for recycling and filtering old coolant.

The liquid pump 103*a* draws liquid out from vacuum tank 1012, and pumps it (either filtered or unfiltered) to fill the engine cooling system with the set up shown in FIGS. 26–29, or can be transferred to another container as shown in FIG. 30. To filter but maintain the liquid in tank 1012, with filter control valve 115 "on",and with bypass switch BPW turned to position "2", the output hose 302 is simply positioned to output the liquid back into tank 1012, as shown in FIG. 31.

4. Filling New Coolant From New Coolant Tank(108)

With function switch FSW turned to position "4",and the main power switch turned to "on",power is applied to lead 7 of control board 160*a*, through resistors R16, R14 and R15, and then on to ground, whereby 1.2 volts actives relay SSR3, which opens outlet cut off valve 110. Power is also applied to pin a4 of function switch FSW, which passes through indicator light L4 (lighting it up) and resistor R24, and then on to ground. Current also goes through diode D8 to lead 31 of control board 160*a*, which actives relay PR103*b* to turn on liquid pump 103*b*. Pump 103*b* draws coolant from tank 108 and pumps it through one way valves 109*a* and 109*b*, through cut off valve 110 and outlet fitting 105, out through output hose 302 in any of the set ups shown in FIGS. 26–29.

Operation of Invention

Figure 25:
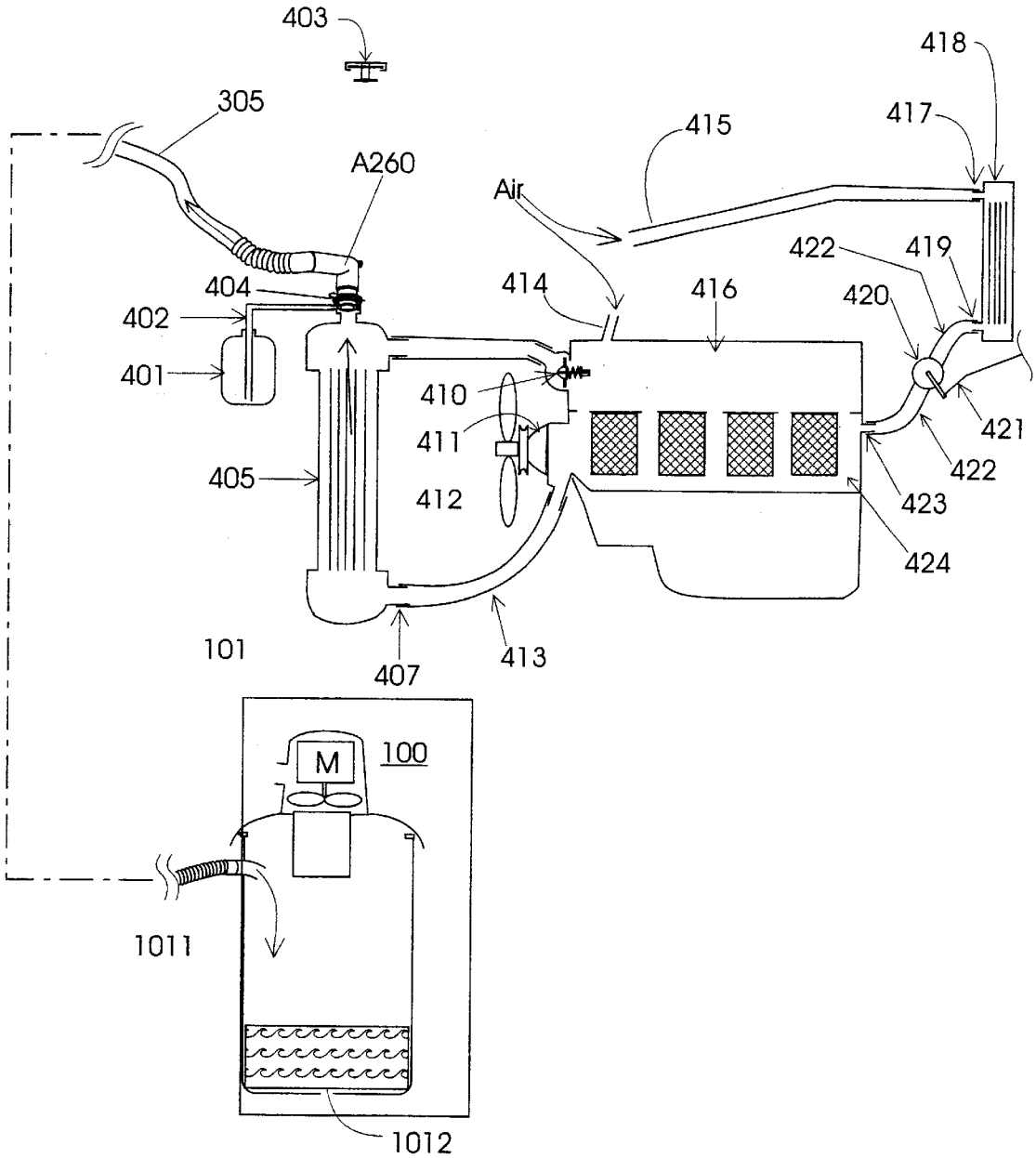
FIG. 25 is a cross-section plan view of the flush and filtration system of the present invention connected to a conventional engine cooling system.

1. Evacuation of Engine Coolant:

To start the flush and filtration of the engine cooling system, the engine is started, the vehicle heater is turned on, the temperature control in the vehicle is switched to warm so the heater control valve 420 (in FIG. 24) in the vehicle is opened and then the engine is turned off. The system 100 (in FIG. 1) is connected to the engine cooling system as shown in FIG. 25, by removing the radiator cap 403 from the radiator filler hole 404 and placing the radiator filler vacuum assembly A260 on radiator filler hole 404. The other end of vacuum hose 305 is connected to vacuum port 1011 of tank 1012. The main power switch SW1 is checked to be in its off position, and electrical power plug PLG is connected to a shop source power outlet, and air inlet 127 is connected to a shop source of compressed air.

The function switch FSW is turned to position "1" and vacuum switch SW101 on vacuum assembly 101 is turned on. Then, the main power switch SW1 (FIG. 2) is turned on which activates motor 1013 to create a vacuum in tank 1012, whereby the vacuum from the vacuum assembly 101 is applied to the top of radiator 405. The coolant in the coolant recovery tank 401 will be sucked out through overflow hose 402 coolant filter 404, radiator vacuum assembly A260, main vacuum hose 305, and into tank 1012. The heater hose 415 is then disconnected from the heater hose fitting 414, whereby at this time no coolant will leak out because of the vacuum applied to the engine cooling system. The engine coolant and outside air from the engine cooling system will be drawn through the elements of the engine cooling system and out through main vacuum hose 305, whereby the coolant in the cooling system is about 40% to 70% evacuated.

Figure 26:
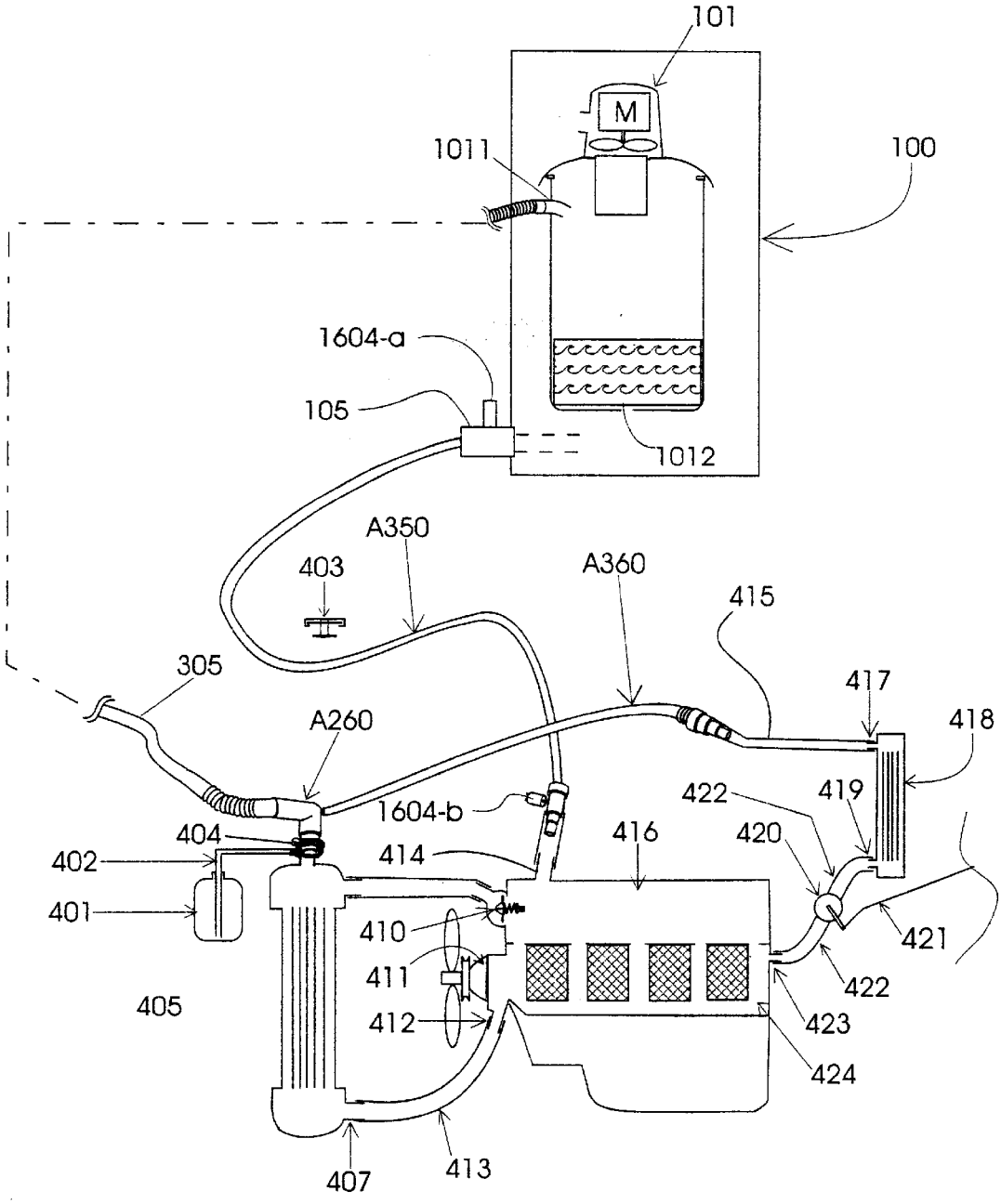
FIG. 26 is a cross-sectional plan view of the a first connection configuration of the flush and filtration system of the present invention to a conventional engine cooling system.
Figure 27:
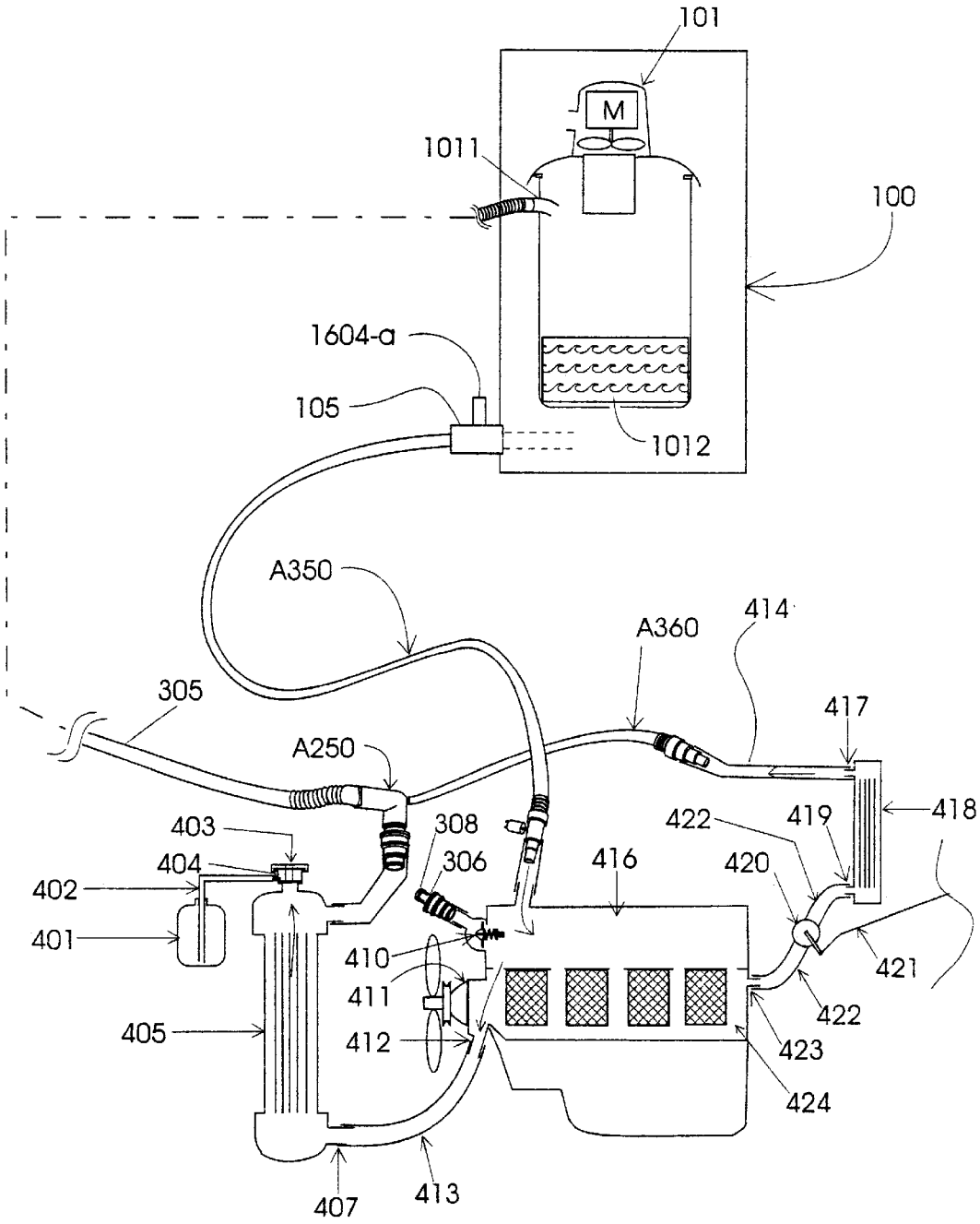
FIG. 27 is a cross-sectional plan view of the a second connection configuration of the flush and filtration system of the present invention to a conventional engine cooling system.

The flush and filtration system 100 is then configured in one of three typical configurations as shown in FIGS. 26, 27 or 28. As shown in FIG. 26, the liquid/air injector 303 of output assembly A350 is attached to the heater return inlet 414, and hose assembly A360 is connected between vacuum joint aperture 200*a* of vacuum joint 200 and heater return hose 415. There is a single point of injection (at the heater return inlet), and two points of extraction (at the heater return hose 415 and the radiator filler hole 404). In FIG. 27, the liquid/air injector 303 of output assembly A350 is attached to the heater return inlet 414, the radiator cap 403 is replaced onto coolant filler 404, vacuum assembly A250 is attached to the radiator inlet using the hose from the thermostat housing 409 (which is blocked by hose plug 306 and plug 308), and hose assembly A360 is connected between vacuum joint aperture 200*a* of vacuum joint 200 and heater return hose 415. There is a single point of injection (at the heater return inlet), and two points of extraction (at the heater return hose 415 and the radiator inlet). In FIG. 28, the hose plug 306 of output assembly A370 is attached to the radiator hose leading to the thermostat housing 409 after the thermostat 410 has been removed, the radiator cap 403 is replaced onto coolant filler 404, vacuum assembly A250 is attached to the radiator inlet (with plug 301 inserted to seal off vacuum joint aperture 200*a*), and heater return hose 415 is reattached to heater return inlet 414. There is a single point of injection (at the thermostat housing 409), and one point of extraction (at the radiator inlet).

Function switch is in its "1" position so that when switch SW1 is activated, motor 1013 is started, which creates a vacuum in tank 1012, vacuum hose 305 and therefore radiator 405. Air regulator 126 is adjusted to 80 pounds per square inch (as read on pressure gauge 125. Switch SW7 is then held down for 4 to 8 seconds, which activates air control valve 124 and outlet cut off valve 110 so that high pressure air from compressed air inlet 127 and from air reserve tank 128 passes through air control valve 124, liquid precharge tank 121, one-way valve 109*c*, cut off valve 110, and outlet fitting 105. The high pressure air also travels through adjustable bypass valve 1223 and one way valve 109*e*, and then mixes with any out-going liquid passing through cut-off valve 110. For evacuation, precharge tank 121 is empty of any liquid, so only the compressed air is injected into the vacuumed chambers of the engine cooling system to carry out almost all of the coolant in the engine into the vacuum tank 1012. Once the evacuation is complete, and main power switch SW1 is turned off.

2. Power Cleaning the Engine Cooling System:

With the flush and filtration system 100 in one of the configurations shown in Figures 26–28, and preferably after the coolant has been evacuated as described above, the air pressure at air regulator 126 is adjusted to between about 45 psi and 65 psi The function switch FSW is moved to position "2",and coolant level switch SW6 is selected to provide the desired coolant level in the coolant pre charge tank 121. In the preferred embodiment, each of the level sensors SL1, SL2, SL3 correspond to about one half gallon of liquid, and it is recommended to set switch SW6 so that coolant pre charge tank 121 fills with coolant approximately equal to one third of the engine coolant system capacity or lees. The coolant level in vacuum tank 1012 is checked, which will serve as the flush and filtration fluid, whereby coolant is added if necessary.

Then the main power switch SW1 is turned on, whereby liquid pump 103A draws coolant from the vacuum tank 1012 (in FIG. 1) and pumps it through filters 107*a*, 107*b* and 107*d* (the filter bypass switch BPW can be selected to close filter control valve 115 and open bypass control valve 114 to bypass filtering). With the liquid pre-charge valve 112 in its open position the coolant from vacuum tank 1012 passes through liquid pre-charge valve 112 and one way check valve 109*d* and into the liquid pre-charge tank 121. The air bypass valve 123 is also adjusted to its open position whereby the air in the liquid pre-charge tank 121 will escape through valve 123, one way valve 109*e*, outlet 105 and hose 302 (allowing liquid to freely fill liquid pre-charge tank 121.

When the coolant fills Lip to the selected level in the liquid pre-charge tank 121, the appropriate sensor (SL1, SL2 or SL3) will trigger control board 160*a*, whereby the timer IC555 will start. The liquid/air injection times are set by time length control VR. When the timer IC555 starts the air control valve 124 and cut-off valve 110 are opened, whereby pressurized air from air inlet 127 is directed into liquid precharge tank 121 which forces the coolant therein out through one way valve 109*c*, cut-off valve 110 and outlet fitting 105. Some of the pressurized air from inlet 127 is diverted around precharge tank 121, whereby it travels through air bypass valve 123 and one way valve 109*e*, and mixes with the outgoing liquid exiting outlet fitting 105. The amount of air mixed with the outgoing wash fluid is adjustable by adjusting air bypass valve 123 (opening air bypass valve 123 increases the amount of air eventually mixed with the outgoing liquid).

It has been determined that if the air mixed with the outgoing liquid forms at least 25% of the outgoing liquid/air mixture, that a superior hurricane-like effect cleaning action occurs because the liquid will separate to small groups and resistance inside the cooling system is reduced, thus increasing the speed of the liquid/air mixture as it passes through the engine cooling system. The speed of the liquid/air flow is further increased by the vacuum applied to the liquid/air extraction point(s) of the engine cooling system by vacuum hose 305 connected to the engine cooling system. The high speed of the liquid/air mixture causes a hurricane effect within the cooling system, effectively dislodging scale and rust deposits that are removed with the liquid wash. After all the liquid from precharge tank 121 is injected into the cooling system, the high pressure air continues to be injected, whereby the pressurized air, in combination with the vacuum applied by vacuum hose 305, evacuates the engine cooling system before the injection cycle ends.

If the pressure in the engine cooling system exceeds a safe pressure limit during the liquid/air injection cycle, pressure switches 1604-*a* or 1604-*b* will turn off the outlet cut-off valve 110 and air control valve 124 to cease the liquid/air injection to prevent any damage to the engine cooling system. In the preferred embodiment, pressure switches 1604-*a* and 1604-*b* are set to be triggered by a pressure of approximately 30 psi, since most engine cooling systems can safely withstand a pressure of 40 psi. In the short period of time it takes to complete the injection cycle, however, high pressure does not build up in the engine cooling system, but a powerful high-speed liquid wash does flush through the cooling system taking with it much of the contaminates that have built up over time.

After all the washing fluid is evacuated from the engine cooling system, the timer is topped, valves 110 and 124 are closed, liquid is refilled into precharge tank 121, and the injection operation cycle is repeated several times until the engine cooling system is completely clean. The clean condition of the system can be checked with a visual check of the clear filter cups in which the filters 107*a–c* are housed. After the engine cooling system is clean and evacuated, switch SW1 (in FIG. 1) is turned off, whereby the system is ready to refill coolant back into the engine cooling system.

3. Filtering and Recycling Old Coolant:

A configuration to filter old coolant is shown in FIG. 31, where the output end of output hose 302 is inserted into vacuum port 1011 of tank 1012. When the function switch FSW is turned to position "3" and filter bypass switch BPW is turned off (where control valve 115 is open and bypass valve 114 is closed); and switch SW1 is turned on, liquid pump 103A draws coolant from tank 1012 and pumps it through the filters 107*a*, 107*b*, 107*c*, and on through valve 115, one way valve 109*b*, cut off valve 110, outlet fitting 105, and through outlet hose assembly 302 back into vacuum tank 1012. The pressure gauges 106*a*, 106*b*, 106*c* monitor the condition of filters 107*a*, 107*b*, 107*c*. A high pressure reading differential across the filters indicates that the filters need replacing. In the preferred embodiment, the filter cups surrounding filters 107*a–c* are clear, thus providing a visual indication of how dirty the filters are.

After the coolant is cleaned, it is ready for transfer to an external storage tank 500 (shown in FIG. 30) or to be refilled into the engine cooling system (as shown in FIG. 29).

Cleaned coolant freezing-temperature point and H. P. level should be checked, whereby concentrated coolant or coolant additives can be added to fix the freezing point or H. P. levels.

4. Filling Coolant Into the Engine Cooling System:

After the engine cooling system is cleaned, the same connection is kept as shown in FIG. 26, 27 or 28. Coolant from vacuum tank 1012 can be refilled into the engine cooling system by setting function switch FSW to position "3" and turning on the main switch SW1. Alternately, new coolant stored in coolant tank 108 can be filled into the engine cooling system by placing function switch FSW to position "4" and the main switch SW1 turned on, whereby liquid pump 103B pumps coolant from coolant tank 108 through one way valves 109*a* and 109*b*, cutoff valve 110, outlet fitting 105, and out through output hose 302. FIG. 29 illustrates using a handheld valve 307 to refill the radiator with coolant. When coolant fills up to about 70% of the engine coolant capacity, all electrical switches are turned off, flush and filtration system 100 is disconnected from the engine, and the engine cooling system is reconnected back to its original condition. The engine is started and warmed up until the thermostats are open and the engine coolant is circulated in the engine cooling system, and the cooling system topped off with coolant after making sure no air pockets are present in the cooling system. After the engine cooling system is fully filled up, the radiator cap is placed back on the radiator.

The flush and filtration system of the present invention provides a superior cooling system cleaning by first pre-evacuating the cooling system by applying both pressurized air mixed with the injected liquid, along with a vacuum applied to one or more extraction points of the engine cooling system. This allows the injection of a high speed liquid/air mixture to create a hurricane like effect that removes contaminants hardened to the interior of the cooling system. This hurricane effect is further achieved by using a relatively high amount of air mixed with the injected liquid, along with repeated and relatively short liquid/air injection times, which results in reduced friction and therefore very high speeds of the washing liquid/air combination as it travels through the cooling system. Further, an injection nozzle with a reduced size is used to accelerate the liquid/air wash as it enters the cooling system. The combination of both pressurization at injection and vacuum at extraction reduces the pressurization at the point of injection necessary to create the desired liquid/air wash speed. If a vacuum were not used in conjunction with the pressurization to inject the liquid/air into the cooling system, the hurricane effect could not be achieved without using a level of pressurization that could damage the cooling system itself. The system uses relatively short bursts of liquid/air wash by repeatedly depleting and then replenishing precharge tank 121, while evacuating the cooling system between each such depletion/replenishment cycle, which maximizes the speed of each subsequent liquid/air injection. The liquid/air injection time length is preferably adjustable from 5 seconds to 20 seconds, which is short enough for high speeds of the liquid/air mixture injections without building up dangerously high pressurizations.

The flush and filtration system 100 also provides a means for conveniently reusing, recycling, and filtering the existing engine coolant, as well as providing a superior means for removing the engine coolant for system cleaning and/or repairs. It also allows the old coolant to be used as the washing/flushing liquid.

A working model of the present invention has been developed with the following specifications:

Power: 115v ac and 12v dc

Air injection pressure: adjustable from 45 psi to 85 psi

Air injection capacity: 150 cf/m with 60 psi pressure

Reserve air tank capacity: 20 gallons

Pre-charge liquid tank capacity: total 1.5 gallons, 0.5 gallons each level, 3 levels capacity: 185 cf/m air Sealed pressure of vacuum: 65 inches of water.

Liquid pump: 45 psi auto shut off, 2 gallons per minute

Air/ liquid injection ratio: 0% to 75% adjustable. Superior cleansing occurs starting with air comprising at least 25%, with excellent results with air comprising up to 75% of the liquid/air mixture.

Solenoid valves: orifice size—½ inches (for liquid), ¾ inches (for air and liquid)
Working pressure—300 psi max
Coil voltage—115 vac Filter capacity: 20 gallons per minute on first stage.
10 gallons per minute on second stage It is to be understood that the present invention is not limited to the sole embodiment described above and illustrated herein, but encompasses any and all variations falling within the scope of the appended claims. For example, the flush and filtration system will work well for cleaning any type of liquid-based cooling system and for any type of liquid coolant, not just an internal combustion engine cooling system. The flushing coolant and coolant used by the cooling system need not be the same type of liquid. The injection and extraction points of the liquid cooling system used by the present invention are any openings, fittings, connections or coolant lines to which output and vacuum lines or connectors can be attached.

The injection and extraction points illustrated in FIGS. 25–29 were selected for ease of connection and effectiveness in evacuation of coolant and removal of contaminants, however the location of the injection and/or extraction points and the number of such injection/extraction points can be varied by the user, even for cleaning the same cooling system (i.e. to alternate the flow direction in the cooling system). While air pressure is used in the preferred embodiment to force the coolant from precharge tank 121 into output hose 302, it is within the scope of the present invention to use a pump similar to pump 103*a* instead. It should be clear that while compressed air and liquid coolant are used with the preferred embodiment, any equivalent gas and any equivalent liquid can be used with, and are within the scope of, the present invention. Lastly, while the use of the precharge tank 121 is preferable because it provides a predetermined amount of liquid for mixture with air and injection into the cooling system, any open or closed loop, internal or external, interrupted or continuous supply of liquid can be used with the present invention (e.g. water faucet, internal or external tanks direct line to vacuum tank 1012, etc.)

What is claimed is:

1. An apparatus for flushing contaminants from an internal combustion engine cooling system that includes a cooling radiator and a heating radiator both connected to an engine block with liquid coolant lines, the flushing apparatus comprising:

an injection hose terminating in an injector that is connectable to the engine block to define an injection point into the engine cooling system;

an evacuation hose terminating in a connector assembly that is connectable to one of cooling radiator and the heating radiator to define a first extraction point from the engine cooling system;

a liquid supply for supplying liquid under pressure to the injection hose and the injection point;

a vacuum motor connected to the evacuation hose for applying a vacuum to the evacuation hose and the first extraction point;

a gas inlet for receiving compressed gas and for mixing the compressed gas with the liquid supplied by the liquid supply to form a liquid and gas mixture;

wherein the liquid and gas mixture enters the engine cooling system at the injection point, travels through the engine block and heating radiator and cooling radiator at a high rate of speed, and is extracted from the engine cooling system at the extraction point by the evacuation hose.

2. The apparatus of claim 1, wherein the gas inlet mixes the compressed gas and the liquid so that the gas forms at least 25% of the liquid and gas mixture.

3. An apparatus for flushing contaminants from an internal combustion engine cooling system that includes a cooling radiator and a heating radiator both connected to an engine block with liquid coolant lines, the flushing apparatus comprising:

an injection hose terminating in an injector that is connectable to the engine block to define an injection point into the engine cooling system;

an evacuation hose terminating in a connector assembly that is connectable to one of cooling radiator and the heating radiator to define a first extraction point from the engine cooling system;

a liquid supply for supplying liquid under pressure to the injection hose and the injection point;

a vacuum motor connected to the evacuation hose for applying a vacuum to the evacuation hose and the first extraction point:

a gas inlet for receiving compressed gas and for mixing the compressed gas with the liquid supplied by the liquid supply to form a liquid and gas mixture;

wherein the liquid and gas mixture enters the engine cooling system at the injection point, travels through the engine block and heating radiator and cooling radiator at a high rate of speed, and is extracted from the engine cooling system at the extraction point by the evacuation hose; and wherein:

the liquid supply includes a pre-charge tank for supplying a predetermined amount of the liquid under pressure to the injection hose and the injection point; and the gas inlet includes a pre-charge tank bypass line for receiving compressed gas and mixing the compressed gas with the liquid supplied by the pre-charge tank to form the liquid and gas mixture.

4. The apparatus of claim 3, wherein the vacuum motor includes a vacuum tank for collecting the liquid extracted from the engine cooling system by the evacuation hose.

5. The apparatus of claim 4, further comprising:

a supply tank for containing liquid coolant; and a supply tank pump for pumping the liquid coolant from the supply tank to the injection hose.

6. The apparatus of claim 4, wherein the injection hose terminates in an injector nozzle that connects to the injection point of the engine cooling system, and has a reduced diameter relative to a diameter of the injection hose for accelerating the liquid and gas mixture flowing there through.

7. The apparatus of claim 4, wherein the connector assembly is further connectable to the other of the one of cooling radiator and the heating radiator for simultaneously defining a second extraction point from the engine cooling system and for applying a vacuum to both the first and second evacuation points simultaneously.

8. The apparatus of claim 4, wherein the gas inlet is further connected to the pre-charge tank so that compressed gas provides force for the supplying of liquid under pressure from the precharge tank to the injection hose.

9. The apparatus of claim 8, wherein the precharge tank bypass line further comprises a gas bypass valve for adjusting a relative amount of compressed gas that bypasses the pre-charge tank and is mixed with the liquid.

10. The apparatus of claim 9, further comprising:

a gas reserve tank connected to the gas inlet, for storing and supplying compressed gas to the precharge tank and the precharge tank bypass line.

11. The apparatus of claim 9, further comprising:

a recycle line connected between the vacuum tank and the pre-charge tank; and a recycle pump for selectively pumping liquid,through the recycle line from the vacuum tank to the pre-charge tank.

12. The apparatus of claim 11, further comprising:

a filter bypass line connected in parallel to at least part of the recycle line;

at least one filter attached to the filter bypass line for filtering any liquid flowing therethrough; and a filter bypass valve for selectively directing liquid flowing in the recycle line to flow through the filter bypass line and the at least one filter.

13. The apparatus of claim 12, further comprising:

a gas control valve connected to the gas inlet for selectively cutting off the supply of compressed gas to the precharge tank and the precharge tank bypass line.

14. The apparatus of claim 12, further comprising:

a controller for controlling the vacuum motor, the recycle pump, the filter bypass valve and the gas control valve.

15. The apparatus of claim 14, wherein the precharge tank includes a plurality of sensors to detect the level of liquid in the precharge tank, and wherein the controller is responsive to the plurality of sensors to deactivate the recycle pump when the detected liquid level reaches a predetermined value.

16. The apparatus of claim 14, further comprising:

a first pressure sensor for measuring the pressure of the liquid and gas mixture in the injection hose, wherein the controller is responsive to the first pressure sensor to deactivate at least one of the vacuum motor, the recycle pump, the filter bypass valve and the gas control valve upon the measurement of pressure that exceeds a predetermined value.

17. The apparatus of claim 16, further comprising:

a second pressure sensor attached to the injector nozzle for measuring a pressure of the liquid and gas mixture at the injection point of the coolant circulation system, wherein the controller is responsive to the second pressure sensor to deactivate at least one of the vacuum motor, the recycle pump, the filter bypass valve and the gas control valve upon the measurement of pressure that exceeds a predetermined value.

18. The apparatus of claim 14, wherein the controller:

activates the recycle pump for pumping a predetermined amount of liquid from the vacuum tank to the precharge tank; and then deactivates the recycle pump; and then activates the gas control valve for forcing the liquid out of the precharge tank, for mixing the forced liquid from the precharge tank with the compressed gas, and for forcing the liquid and gas mixture into injection hose and into the engine cooling system, and activates the vacuum pump to evacuate the;liquid and gas mixture from the engine cooling system, through the evacuation hose, and into the vacuum tank; and then deactivates the gas control valve and the vacuum pump;

wherein said recycle pump activation and deactivation steps, and said gas control valve activation and deactivation steps and said vacuum pump activation and deactivation steps, are repeated a plurality of times.

19. A method of flushing contaminants from an internal combustion engine cooling system that includes a cooling radiator and a heating radiator both connected to an engine block with liquid coolant lines, and points of injection and extraction, the method comprising the steps of:

mixing a liquid with a gas to create a liquid/gas mixture;

injecting the liquid/gas mixture into an injection point of the engine cooling system under pressure;

applying a vacuum to an extraction point of the engine cooling system to evacuate the liquid/gas mixture through the extraction point.

20. A The method of claim 19, wherein the injecting step and applying step are performed simultaneously to create a high speed of flow of the liquid/gas mixture through the engine cooling system.

21. The method of claim 20, wherein the injecting step is performed to the engine block, and the applying step is performed to the cooling radiator.

22. The method of claim 20, wherein the engine cooling system has a plurality of extraction points, and the applying step is performed at the plurality of extraction points simultaneously.

23. The method of claim 22, wherein the injecting step is performed to the engine block, and the applying step is performed to the cooling radiator and the heating radiator simultaneously.

24. The method of claim 20, further comprising the step of:

evacuating liquid coolant from the engine cooling system before the injecting and applying steps by injecting a gas into the injection point of the engine cooling system under pressure while simultaneously applying a vacuum to the extraction point of the engine cooling system.

25. The method of claim 20, wherein the mixing step is performed so that the gas forms at least 25% of the liquid/gas mixture.

26. The method of claim 20, further steps of:

filtering the evacuated liquid; and repeatedly performing the mixing, injecting and applying steps using the filtered liquid.

* * * * *

UNITED STATES PATENT AND TRADEMARK OFFICE

CERTIFICATE OF CORRECTION

PATENT NO. : 6,637,468 B1
DATED : October 28, 2003
INVENTOR(S) : Derek Chen-Chien Wu It is certified that error appears in the above-identified patent and that said Letters Patent is hereby corrected as shown below:

Drawings,
Figures 27, 28 and 29, element number “414”should be -- 415 --.

Column 1,
Line 37, “the; contamination.” should read -- the contamination. --
Line 38, “removing,:filtering,” should read -- removing, filtering, --

Column 2,
Line 59, “an cross-sectional” should read -- a cross-sectional --

Column 3,
Line 32, “a exploded” should read -- a exploded --
Line 60, “the a first” should read -- the first --
Line 64, “the a second” should read -- the second --

Column 4,
Line 1, “the a third” should read -- the third --
Line 28, element “41” should read -- 411 --
Line 31, element “41.6” should read -- 416 --
Line 51, “contrller” should read -- controller --

Column 5,
Line 20, element “16A-B” should read -- 15A-B --

Column 6,
Line 47, “l” should read -- 1 --

Column 7,
Line 48, “3 Of” should read -- 3 of --

UNITED STATES PATENT AND TRADEMARK OFFICE

CERTIFICATE OF CORRECTION

PATENT NO. : 6,637,468 B1
DATED : October 28, 2003
INVENTOR(S) : Derek Chen-Chien Wu It is certified that error appears in the above-identified patent and that said Letters Patent is hereby corrected as shown below:

Column 8,
Line 5, "R118" should be -- R18 --

Column 16,
Line 4, "the;liquid" should read -- the liquid --

Signed and Sealed this

Fifteenth Day of June, 2004

JON W. DUDAS
*Acting Director of the United States Patent and Trademark Office*